US008217310B2

(12) United States Patent
Sakurai

(10) Patent No.: US 8,217,310 B2
(45) Date of Patent: Jul. 10, 2012

(54) GLOW PLUG ELECTRIFICATION CONTROL APPARATUS AND GLOW PLUG ELECTRIFICATION CONTROL SYSTEM

(75) Inventor: Takayuki Sakurai, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 316 days.

(21) Appl. No.: 12/475,022

(22) Filed: May 29, 2009

(65) Prior Publication Data

US 2009/0294431 A1 Dec. 3, 2009

(30) Foreign Application Priority Data

May 30, 2008 (JP) ..... 2008-142459

(51) Int. Cl.
*F23Q 7/00* (2006.01)
*F02P 19/02* (2006.01)

(52) U.S. Cl. ..... 219/268; 123/179.6

(58) Field of Classification Search ..... 219/268, 219/260, 261, 262, 263, 264, 265, 266, 267, 219/269, 270; 123/179.6, 179.1, 179.2, 179.3, 123/179.4, 179.5

See application file for complete search history.

(56) References Cited

U.S. PATENT DOCUMENTS

| | | | | |
|---|---|---|---|---|
| 7,658,174 | B2 * | 2/2010 | Stoller | 123/145 A |
| 2001/0050275 | A1 * | 12/2001 | Uhl | 219/270 |
| 2003/0127450 | A1 * | 7/2003 | Uhl et al. | 219/494 |
| 2004/0255889 | A1 | 12/2004 | Kumada et al. | |
| 2007/0045276 | A1 * | 3/2007 | Fisher et al. | 219/268 |
| 2009/0294431 | A1 * | 12/2009 | Sakurai | 219/268 |

FOREIGN PATENT DOCUMENTS

| | | | |
|---|---|---|---|
| JP | 56129763 | A | 10/1981 |
| JP | 6067775 | A | 4/1985 |
| JP | 05-113166 | A | 5/1993 |
| JP | 05-256449 | A | 10/1993 |
| JP | 2004-044580 | A | 2/2004 |
| JP | 2004044580 | A | 2/2004 |
| JP | 2004232907 | A | 8/2004 |

* cited by examiner

*Primary Examiner* — Daniel L Robinson
(74) *Attorney, Agent, or Firm* — Sughrue Mion, PLLC

(57) ABSTRACT

A glow plug electrification control apparatus which can maintain the same heater temperature even when resistance varies among glow plugs to be used, and a glow plug electrification control system using the same. The apparatus (101) includes temperature-raising-period-resistance acquisition means for temperature-raising-period resistances Rg1(0.5), etc. of glow plugs (GP1-GPn) at predetermined timings during a temperature-raising period; maintaining-period electrification control means for maintaining the heater temperature Tg1(*t*), etc. at predetermined target temperatures Tm1, etc. after the temperature raising; and maintaining-period resistance acquisition means for acquiring maintaining-period resistances Rg1(*t*), etc. of the glow plugs GP1, etc. in a maintaining period.

10 Claims, 16 Drawing Sheets

GLOW PLUG ELECTRIFICATION CONTROL APPARATUS AND GLOW PLUG ELECTRIFICATION CONTROL SYSTEM

BACKGROUND OF THE INVENTION

1. Field of the Invention

The present invention relates to a glow plug electrification control apparatus for controlling supply of electric current to a glow plug that assists startup of an internal combustion engine, and to a glow plug electrification control system using the same.

2. Description of the Related Art

In general, a glow plug has a resistance heater which is caused to generate heat upon supply of electric current thereto. The glow plug is configured such that a resistance heater is attached to a metallic shell, and is attached to the engine block of a diesel engine such that the distal end of the resistance heater is located within a combustion chamber.

A glow plug electrification control apparatus has been known as an apparatus for controlling supply of electric current to such a glow plug. Since such a glow plug has a relatively high resistance, a conventional glow plug electrification control apparatus is configured as follows. When a key switch is turned to an ON position, a switch (switching element) between a battery and the glow plug is maintained ON so as to supply a large current to the glow plug and raise the temperature of the heat generation section to a first target temperature (e.g., 1300° C.) which is sufficiently high for starting the engine. Such a step is generally called "pre glow" or a "pre glow step." A glow plug capable of quick heating can raise the temperature of its heat generation section to the first target temperature within a few seconds (see e.g., Japanese Patent Application Laid-Open (kokai) No. S56-129763).

In recent years, a glow plug of a quick temperature raising type has been developed which can raise the temperature of its heat generation section to 1300° C. or higher (e.g., 1300° C.) within about 2 seconds, by further reducing of the resistance of the heat generation section, which enables a large current to flow through the heat generation section.

In a known control method performed while the temperature of the glow plug rises, the amount of cumulative power supplied to the glow plug is controlled so as to raise the temperature of the glow plug to a sufficiently high temperature without being affected by the battery voltage and so as to prevent excessive temperature rise. Specifically, voltage applied to the glow plug during the temperature rise and current flowing through the glow plug during the temperature rise are measured; electric power supplied to the glow plug is calculated and integrated so as to calculate the cumulative amount of electric power; and the temperature of the glow plug is raised until the cumulative amount of electric power reaches a predetermined value (see e.g., Japanese Patent Application Laid-Open (kokai) No. S60-67775).

Moreover, in a known technique, after the temperature of the heat generation section has been raised, the temperature of the heat generation section (heater temperature) is maintained in order to assist startup of an engine, stabilize operation of the engine after the startup, and reduce emissions (see e.g., Japanese Patent Application Laid-Open (kokai) No. 2004-44580). Specifically, this document describes that, in order to maintain constant the heater temperature of a glow plug whose resistance has a positive correlation with the heater temperature, the resistance of the glow plug is controlled such that it coincides with a target resistance. When such a control is performed, even when a disturbance (swirl or the like) arises, the heater temperature is readily maintained constant.

Notably, the resistance of the glow plug to be controlled includes not only the resistance of the heat generation section, but also the resistances of other members of the glow plug which form a path for supplying electricity to the heat generation section, and the resistance of a lead wire (wire harness) for supplying electric current to the glow plug.

3. Problem to be Solved by the Invention

However, even glow plugs of the same part number, which are industrially handled as the same part and are considered to have the same performance, show variations in the resistances of the heat generation sections, and thus show variations in their respective resistances.

Accordingly, when a battery voltage is applied via a switching element to a glow plug having a relatively low overall resistance because of a relatively low resistance of the heat generation section, a relatively large amount of current flows through the glow plug. As a result, the temperature rises quickly, so that the glow plug reaches a high temperature within a short period of time, and the cumulative amount of electric power supplied to the glow plug reaches a predetermined value within a short period of time. In addition, since the temperature of the glow plug rises within a short period of time, the amount of heat which escapes from the glow plug to an engine head or the like during the temperature rise decreases. Thus, the low-resistance heat generation section reaches a higher temperature, as compared with a glow plug which is high in resistance, even when the same cumulative electric power is supplied.

Further, when the resistance of the glow plug, including the lead wire, is then controlled to match the resistance to a target resistance, to thereby maintain the heater temperature, a relatively large amount of current is supplied to the glow plug so as to greatly increase the resistance. Therefore, the heater temperature is maintained at a relatively high temperature.

Meanwhile, in the case where the resistance of the glow plug, including that of the lead wire, is relatively large, a relatively small amount of current flows through the glow plug upon application of the battery voltage through the switching element. As a result, the speed of temperature rise is low, so that the glow plug requires a long period of time to reach a high temperature, and a long period of time is required for the amount of electric power supplied to the glow plug to reach the predetermined value. In addition, since the glow plug requires a long period of time to reach a high temperature, a larger amount of heat escapes from the glow plug to the engine head or the like during the temperature rise. As a result, the heater temperature can reach only a relatively low temperature, as compared with a glow plug which is low in resistance, even when the same electric power is supplied.

Further, when the resistance is then controlled so as to render the resistance coincident with the target resistance, to thereby maintain the heater temperature, a relatively small amount of current is supplied to the glow plug so as to prevent a great increase in the resistance. Therefore, the heater temperature is maintained at a relatively low temperature.

That is, due to variations in resistance among glow plugs (heat generation sections), variation arises not only in the temperature rising time but also in the temperature which the glow plugs can reach and in the heater temperature which is maintained through resistance control.

For example, in the case where the resistance of the glow plug, including the lead wire, is controlled to a predetermined fixed target resistance as described above, although the heater temperature of the glow plug can be maintained constant, a variation arises in the value itself of the heater temperature of the glow plug. In some cases, the variation in the heater temperature reaches several tens of deg C. to 200 deg C.

As described above, due to variations in the resistance of the glow plug, various problems arise, such as variation in engine startability and variation in ignitability immediately after startup.

SUMMARY OF THE INVENTION

The present invention has been accomplished in view of the above-described problems, and an object of the present invention is to provide a glow plug electrification control apparatus which can maintain the same heater temperature among glow plugs to be used even when resistance varies among the heat generation sections of the glow plugs, as well as a glow plug electrification control system using the same.

These objects are achieved by a glow plug electrification control apparatus which controls supply of electric current, via a lead wire, to a glow plug which includes a heat generation section generating heat when supplied with electric current, and whose resistance has a positive correlation with its heater temperature. The control apparatus includes temperature-raising-period electrification control means for raising the heater temperature of the glow plug; maintaining-period electrification control means for maintaining the heater temperature at a predetermined target temperature after the heater temperature has been raised; temperature-raising-period-resistance acquisition means for acquiring, as a temperature-raising-period resistance, a resistance of the glow plug. That includes a resistance of the lead wire and that is measured at a predetermined timing in a temperature-raising period in which the temperature-raising-period electrification control means raises the heater temperature; and maintaining-period resistance acquisition means for acquiring, as a maintaining-period resistance, the resistance of the glow plug including that of the lead wire and that is measured at a predetermined timing in a maintaining period in which the maintaining-period electrification control means maintains the heater temperature. The maintaining-period electrification control means includes target resistance acquisition means for acquiring a target resistance corresponding to the target temperature on the basis of the temperature-raising-period resistance, and maintaining-period resistance control means for controlling the supply of electricity to the glow plug such that the maintaining-period resistance coincides with the target resistance.

In order to cause glow plugs to maintain the same heater temperature during the maintaining period irrespective of variations in the resistances of the glow plugs and lead wires caused by variations in the resistances of the heat generation sections, preferably, a target resistance suitable for each glow plug, including a lead wire (hereinafter also referred to as the "glow plug, etc.") is determined in consideration of variations in the resistance of the glow plug, etc., and the resistance (maintaining-period resistance) of the glow plug, etc. is controlled such that the maintaining-period resistance coincides with the target resistance.

In view of the above, in the glow plug electrification control apparatus of the present invention, the temperature-raising-period-resistance acquisition means acquires a temperature-raising-period resistance, which is the resistance of the glow plug, etc. measured at a predetermined timing during the temperature-raising period, in which the heater temperature is raised. Further, the target resistance acquisition means acquires a target resistance corresponding to the target temperature on the basis of the temperature-raising-period resistance. Then, the maintaining-period resistance control means controls the supply of electric current to the glow plug such that the maintaining-period resistance of the glow plug, etc. coincides with the target resistance.

Since the temperature-raising-period resistance includes a variation in resistance stemming from differences in characteristics among glow plugs, the variation in resistance among glow plugs can be reflected in the control by means of acquiring the target resistance on the basis of the temperature-raising-period resistance.

In addition, as compared with the case where the resistance of the glow plug, etc. before the temperature raising is used, the correlation between the temperature-raising-period resistance measured in the temperature-raising period and the maintaining-period resistance of the glow plug, etc. heated to a high temperature is large. Therefore, even when the environmental temperature (e.g., engine water temperature and ambient temperature) of the glow plug varies (i.e., irrespective of whether the environmental temperature is low or high), a proper target resistance can be acquired.

The reason for this is as follows. That is, the resistance of a glow plug is composed of not only the resistance of the heat generation section, but also of the resistances of members through which electricity is supplied to the heat generation section, such as a lead member (electricity supply terminal rod) and a metallic shell, which communicate with the heat generation section. Before electricity is supplied to the glow plug, the magnitudes of the resistances of the members other than the heat generation section are greatly influenced by the environmental temperature (for example, if the engine is cool and the entire glow plug has a temperature near room temperature, or if the water temperature of the engine is still high and the glow plug has a relatively high temperature). Moreover, the overall resistance of the glow plug includes a small resistance of the lead wire.

Incidentally, when a glow plug is quickly elevated in temperature, the temperature of the heat generation section, which is a portion of an electricity supply path, increases sharply, whereby the resistance of the heat generation section increases greatly. Meanwhile, the resistances of portions other than the heat generation section do not change greatly, because of the following reason. Even when the temperature of the heat generation section increases sharply, the temperature of the lead member or the like does not change greatly, as compared with the heat generation section, because the lead member or the like receives only a small amount of heat from the heat generation section or the started engine within a short period of time during the temperature raising. Further, the resistance of the lead wire is not very large.

Therefore, whereas the ratio of the total resistance of the lead wire and portions other than the heat generation section to the resistance of the glow plug, etc. is relatively high before the heater temperature is raised, the ratio of the total resistance of the lead wire and portions other than the heat generation section to the resistance of the glow plug, etc. is relatively low in the temperature-raising period. Therefore, when the target resistance is acquired by use of the resistance of the glow plug, etc. in the temperature-raising period rather than that before the temperature-raising period, the influence of the resistances of the portions other than the heat generation section, which are apt to be affected by the environmental temperature, becomes relatively small. Further, conceivably, the ratio of the total resistance of the portions other than the heat generation section becomes the smallest when the heater temperature reaches the target temperature.

Also, in a state where the heater temperature of the heat generation section is subsequently maintained at a high temperature, the temperatures of the lead wire and the portions other than the heat generation section increase gradually, and their resistances increase. Therefore, conceivably, the ratio of the total resistance of the lead wire and the portions other than the heat generation section to the resistance (maintaining-period resistance) of the glow plug, etc. increases again. However, when the temperatures of the portions other than the heat generation section increase, conceivably, the influence of, for example, the ambient temperature on the resistances of the portions becomes very small.

Accordingly, use of the temperature-raising-period resistance, which is closer to the maintaining-period resistance as compared with the resistance before the temperature raising, is preferred even when the influence of the environmental temperature on the total resistance of the lead wire and the portions other than the heat generation section is considered.

Moreover, in the case where the resistance of the glow plug can be measured a plurality of times during the temperature-raising period, preferably, a value obtained last is used.

Notably, a positive correlation between the resistance of the glow plug and the heater temperature means that the resistance of the glow plug increases with the heater temperature.

Examples of glow plugs to which the present invention is applicable include a so-called metal glow plug whose heat generation section is formed of a metal wire which is caused to generate heat through supply of electric current to the metal wire, and a so-called ceramic glow plug whose heat generation section is formed of an electrically conductive ceramic which is caused to generate heat through supply of electric current to the ceramic.

The lead wire is an electrically conductive member which is provided between the electrification control apparatus of the present invention and the glow plug so as to supply electricity to the glow plug. An example of the lead wire is a wire harness which connects the electrification control apparatus and the glow plug together.

Any means may be used as the temperature-raising-period-resistance acquisition means, so long as the selected means can acquire the temperature-raising-period resistance. An example of such means is a means for obtaining a voltage applied to the glow plug in the temperature-raising period (temperature-raising-period voltage) and a current flowing through the glow plug (temperature-raising-period current), and calculating the temperature-raising-period resistance. In the case where pulse width modulation (PWM) control is performed, the temperature-raising-period resistance of the glow plug may be calculated from a divided voltage output from a voltage division circuit which divides a known voltage by the glow plug and a reference resistor in a period in which no electricity is supplied to the glow plug.

Further, any means may be used as the maintaining-period-resistance acquisition means, so long as the selected means can acquire the maintaining-period resistance. An example of such means is a means for obtaining a voltage applied to the glow plug in the maintaining period (maintaining period voltage) and a current flowing through the glow plug (maintaining-period current), and calculating the maintaining-period resistance. In the case where PWM control is performed, the maintaining-period resistance of the glow plug may be calculated from a divided voltage output from a voltage division circuit which divides a known voltage by the glow plug and a reference resistor during a period in which no electricity is supplied to the glow plug.

The glow plug electrification control apparatus comprises cranking detection means for detecting cranking of an engine, wherein the temperature-raising-period-resistance acquisition means acquires the temperature-raising-period resistance every time each of a plurality of predetermined timings falls within the temperature-raising period, at least until the cranking detection means detects the cranking; and the maintaining-period electrification control means acquires the target resistance on the basis of the latest temperature-raising-period resistance among temperature-raising-period resistances at the predetermined timings which were obtained before the cranking detection means detected the cranking.

When a driver starts the engine (performs cranking) during the temperature-raising period, in some cases, the heater temperature is prevented from rising or is lowered, because the heat generation section of the glow plug is cooled by injection of fuel and swirls generated as a result of cranking. Accordingly, difficulty is encountered in obtaining a sufficiently adequate target resistance by making use of the temperature-raising-period resistance of the glow plug, etc. acquired at a timing in the temperature-raising period after the cranking. In other words, when cranking is performed, a target resistance can be acquired properly by making use of the temperature-raising-period resistance acquired before the cranking.

Meanwhile, in the case where the temperature-raising-period resistance of the glow plug, etc. was able to be acquired a plurality of times in the temperature-raising period before the engine was started (cranking was performed), a more adequate target resistance can be acquired by making use of the latest temperature-raising-period resistance acquired at a point in time closer to the maintaining period. The same holds true for the case where the temperature-raising-period resistance of the glow plug, etc. was able to be acquired a plurality of times because the engine was not started in the temperature-raising period.

In the glow plug electrification control apparatus of the present invention, in the temperature-raising period, the temperature-raising-period resistance is acquired every time each of the predetermined timings comes, at least until cranking is detected. Further, the maintaining-period electrification control means acquires a target resistance on the basis of the latest temperature-raising-period resistance among the temperature-raising-period resistances acquired at the predetermined timings before the cranking was detected. Therefore, a proper target resistance can be acquired irrespective of presence/absence of cranking.

In the glow plug electrification control apparatus, preferably, when the cranking detection means detects cranking before the first one of the predetermined timings falls within the temperature-raising period, the temperature-raising-period-resistance acquisition means acquires the temperature-raising-period resistance at the first predetermined timing; and, when the temperature-raising-period resistance was not detected before detection of the cranking, the maintaining-period electrification control means acquires the target resistance on the basis of the temperature-raising-period resistance detected at the first predetermined timing.

In the glow plug electrification control apparatus of the present invention, even when a driver starts the engine (performs cranking) at the beginning of the temperature-raising period, the temperature-raising-period resistance at the first predetermined timing is acquired, and the target resistance is acquired on the basis thereof.

As described above, during cranking, the heat generation section is cooled and the heater temperature changes greatly, due to, for example, the presence of a swirl affecting the heat generation section of the glow plug. Therefore, unlike the case where cranking is not performed, the acquired temperature-raising-period resistance does not properly reflect variations in the resistance of the glow plug. However, the acquired temperature-raising-period resistance is somewhat influenced by the variations in the resistance of the glow plug.

Accordingly, when the target resistance is acquired on the basis of the temperature-raising-period resistance acquired after cranking, although it is insufficient, the control for rendering the heater temperature of each glow plug coincident with the target temperature can be performed better than in the case where the target resistance is set without regard to the temperature-raising-period resistance (e.g. the target resistance is set to a fixed value) or the case where a predetermined voltage is continuously applied to the glow plug.

In the glow plug electrification control apparatus, the temperature-raising-period electrification control means controls electrification in such a manner that, even when a first glow plug and a second glow plug, which are, e.g., of the same part number but differ in resistance due to a characteristic variation therebetween, are selectively connected to the electrification control apparatus and electrification control is performed therefor, at sampled timings during the temperature rise, electric power of the same magnitude as that supplied to the first glow plug is supplied to the second glow plug, if the temperature of the heat generation section of the second glow plug is raised under the same environmental temperature condition as that under which the temperature of the heat generation section of the first glow plug is raised.

In the glow plug electrification control apparatus of the present invention, the temperature-raising-period electrification control means performs power control for the glow plug at sampled timings which is to be understood as including continuous monitoring and control. That is, even when a first glow plug and a second glow plug, which differ in resistance, are selectively connected to the electrification control apparatus and electrification control is performed therefor, electric power of the same magnitude as that supplied to the first glow plug is supplied to the second glow plug at each respective time, if the temperature of the heat generation section of each of the first glow plug and the second glow plug is raised under the same environmental temperature condition.

Accordingly, although the first glow plug and the second glow plug differ in resistance, if the first glow plug and the second glow plug are placed under the same environmental temperature condition, the temperatures of the first glow plug and the second glow plug rise while following the same temperature rising curve. That is, when the resistances of the first glow plug and the second glow plug are measured when predetermined periods of time (e.g., 0.5 seconds, 1.0 second, etc.) have elapsed after the start of the temperature rise, the resistances (temperature-raising-period resistances) of the first glow plug and the second glow plug at the same heater temperature (e.g., 300° C., 600° C., etc.) can be obtained.

In addition, the resistances (temperature-raising-period resistances) reflect variations in the resistance of the glow plug, etc.; in particular, variations in the heat generation section. Therefore, if a target resistance is acquired on the basis of such a temperature-raising-period resistance, a target resistance suited for the characteristics of each glow plug (heat generation section) can be set.

Notably, no limitation is imposed on a pattern according to which electric power is supplied to the first glow plug and the second glow plug so as to raise their temperatures, so long as electric power of the same magnitude is supplied to the first glow plug and the second glow plug at each point in time. Accordingly, examples of the electric power supply pattern include a pattern in which constant electric power is continuously supplied and a pattern in which the magnitude of electric power to be supplied is decreased gradually (specifically, the magnitude of electric power to be supplied is decreased continuously or the magnitude of electric power to be supplied is decreased stepwise).

Further, the first glow plug and the second glow plug to be compared can be placed under the same ambient temperature condition by means of, for example, attaching the first glow plug and the second glow plug to the same engine or engines of the same model, and maintaining the same ambient temperate and the same engine cooling water temperature.

Examples of a method of controlling electric power supplied to a glow plug include a method in which a battery voltage is applied to a glow plug (first or second glow plug) via a switching element, and the electric power applied to the glow plug (first glow plug, etc.) is controlled by means of PWM control which turns the switching element on and off; and a method in which electric power supplied to a glow plug is controlled by means of limiting the current flowing through the glow plug.

In the above-described glow plug electrification control apparatus, preferably, the temperature-raising-period electrification control means includes supply power magnitude control means for supplying the glow plug with electric power of a magnitude which is previously determined in accordance with a time elapsed from the start of supply of electricity to the heat generation section.

In this glow plug electrification control apparatus, in the temperature-raising period, the glow plug is supplied with electric power whose magnitude is previously determined in accordance with a time elapsed from start of electrification. Accordingly, even when the first glow plug and the second glow plug which differ in resistance are selectively connected to the electrification control apparatus, the first glow plug and the second glow plug can receive electric power of the same magnitude at each point in time and generate heat of the same amount. Therefore, the temperatures of the heat generation sections of the first glow plug and the second glow plug, which differ in resistance, can be raised to generally follow the predetermined same temperature rising curve.

Notably, preferably, electric power whose magnitude is previously determined in accordance with a time elapsed from start of electrification is supplied to the glow plug in accordance with a pattern determined such that a large amount of electric power is supplied in an initial stage after the start of electrification (in a low temperature region) so as to increase the temperature of the heat generation section to a high-temperature region within a short period of time, and, when a certain period of time has elapsed and the temperature of the heat generation section has reached a high temperature, a relatively small amount of electric power is supplied so as to prevent the temperature of the heat generation section from becoming excessively high. An example of such an electric power supply pattern is a pattern in which electric power to be supplied is decreased gradually (decreased continuously or stepwise).

In the above-described glow plug electrification control apparatus, preferably, the supply power control means includes reference power magnitude provision means for providing a reference power magnitude Pb(t) to be supplied to the glow plug at elapsed time t, as counted from the start of supply of electricity to the heat generation section; and power magnitude control means for performing electrification control such that the magnitude of electric power supplied to the glow plug at the elapsed time t coincides with the reference power magnitude Pb(t).

In this glow plug electrification control apparatus, the reference power magnitude provision means provides a reference power magnitude Pb(t) to be used at the elapsed time t, and the power magnitude control means performs electrification control such that the magnitude of electric power supplied to the glow plug coincides with the reference power magnitude Pb(t). By virtue of such control, even when the first plug and the second plug, which differ in resistance, are selectively connected to the electrification control apparatus, at each point in time, the magnitude of electric power to be supplied to the first glow plug and the magnitude of electric power to be supplied to the second glow plug can be readily rendered equal to the reference power magnitude Pb(t).

Notably, the reference power magnitude Pb(t) may be a value determined from the elapsed time t only. Alternatively, the reference power magnitude Pb(t) may be a value reflecting the ambient temperature, the water temperature of an engine, and a time elapsed from a previous operation; e.g., a value which is properly corrected in consideration of these conditions.

Further, in the glow plug electrification control apparatus, preferably, the power magnitude control means includes parameter (voltage-etc.) acquisition means for acquiring, at each elapsed time t, a voltage Vg(t) applied to the glow plug and the lead wire and at least one of a current Ig(t) flowing through the glow plug and the lead wire and a resistance Rg(t) of the glow plug; duty ratio acquisition means for acquiring a duty ratio D(t) by use of the reference power magnitude Pb(t), the applied voltage Vg(t), and at least one of the current Ig(t) and the resistance Rg(t); and pulse electrification means for supplying the glow plug and the lead wire with electricity in the form of pulses and at the duty ratio D(t).

In this glow plug electrification control apparatus, the parameter (voltage-etc.) acquisition means acquires at least one of the current Ig(t) and the resistance Rg(t), as well as the applied voltage Vg(t), for the glow plug, and the duty ratio acquisition means acquires the duty ratio D(t) from these data and the reference power magnitude Pb(t). Further, the pulse electrification means supplies the glow plug, etc. with electricity in the form of pulses and at the duty ratio D(t).

By virtue of such control, even when the first plug and the second plug, which differ in resistance, are selectively connected to the electrification control apparatus, the magnitude of electric power to be supplied to the first glow plug and the second glow plug at each elapsed time t can be readily rendered equal to the reference power magnitude Pb(t) through PWM control.

Notably, the duty ratio acquisition means may employ a method of calculating the duty ratio D(t) from the reference power magnitude Pb(t) and at least one of the current Ig(t) and the applied voltage Vg(t), and calculating the duty ratio D(t) such that the magnitude of electric power supplied to the glow plug becomes equal to the reference power magnitude Pb(t). Specifically, preferably, the duty ratio D(t) is determined in accordance with the following expression.

$$D(t)=Pb(t)\cdot Rg(t)/Vg(t)^2=Pb(t)/(Vg(t)\cdot Ig(t)).$$

In the glow plug electrification control apparatus, the supply power control means includes parameter (voltage-etc.) acquisition means for acquiring, at each elapsed time t, a voltage Vg(t) applied to the glow plug and the lead wire, and at least one of a current Ig(t) flowing through the glow plug and the lead wire and a resistance Rg(t) of the glow plug and the lead wire; duty ratio acquisition means for acquiring a duty ratio D(t) from the resistance Rg(t) and the applied voltage Vg(t); and pulse electrification means for supplying the glow plug and the lead wire with electricity in the form of pulses and at the duty ratio D(t).

In this glow plug electrification control apparatus, the parameter (voltage-etc.) acquisition means acquires at least one of the current Ig(t) and the resistance Rg(t), as well as the applied voltage Vg(t), and the duty ratio acquisition means acquires the duty ratio D(t) from these data. Further, the pulse electrification means supplies the glow plug, etc. with electricity in the form of pulses and at the duty ratio D(t).

By virtue of such control, even when the first plug and the second plug, which differ in resistance, are selectively connected to the electrification control apparatus, the magnitude of electric power to be supplied to the first glow plug and the second glow plug at each elapsed time t can be readily controlled through PWM control.

Notably, other example methods which the duty ratio acquisition means may employ include a method of calculating the duty ratio D(t) from the applied voltage Vg(t) and at least one of the current Ig(t) and the resistance Rg(t), and a method of acquiring the duty ratio D(t) by reference to a correspondence table in which, for each elapsed time t, a duty ratio D(t) is related to the applied voltage Vg(t) and at least one of the current Ig(t) and the resistance Rg(t).

In the glow plug electrification control apparatus, preferably, the target resistance acquisition means acquires the target resistance using a predetermined primary expression having the temperature-raising-period resistance at the predetermined timing as a variable.

It has been found that, in the case where the temperature-raising-period electrification control means performs power control for the glow plug at each point in time, even if the environmental temperature (e.g., the water temperature of the engine, the ambient temperature, etc.) changes, a relation expressed by such a primary expression is present between the temperature-raising-period resistance at the predetermined timing (e.g., when 0.5 seconds or 1.0 second has elapsed after the start of the temperature raising) and the target resistance which the glow plug, etc. exhibit at the time when the heater temperature reaches the target temperature.

In the glow plug electrification control apparatus of the present invention, since the target resistance acquisition means uses such a predetermined primary expression whose variable is the temperature-raising-period resistance, the target resistance can be readily acquired.

Preferably, the glow plug electrification control apparatus further comprises first environmental value acquisition means for acquiring a first environmental value for a predetermined environmental condition before or during the temperature-raising period, and second environmental value acquisition means for acquiring a second environmental value for the predetermined environmental condition during the maintaining period, wherein the maintaining-period electrification control means includes environment correction means for correcting the target resistance using the second environmental value and the first environmental value.

As described above, in the glow plug, the heat generation section is the main portion producing the resistance thereof. However, members such as a metallic shell, an electricity supply member within the glow plug, a lead wire attached to the glow plug, and the like exhibit a small resistance (for example, about 10% of the entire resistance).

Of these members, the heat generation section increases in resistance with the temperature thereof. Further, other resistor portions which exhibit resistances, such as the metallic shell, the electricity supply member within the glow plug, and the lead wire attached to the glow plug, also increase in resistance with the temperature.

However, the temperature of the heat generation section is raised to, for example, 1300° C. through supply of the electricity thereof. Meanwhile, the other resistor portions, such as the electricity supply member, do not become very high in temperature as a whole, and their temperatures are generally influenced by the temperatures of the engine block, etc., located around the glow plug; accordingly, the temperatures of engine cooling water, etc., and become approximately equal to those temperatures.

Further, the temperatures of engine cooling water, etc. gradually increase after the engine operates for a while after startup. That is, the temperature of the heat generation section is raised to a high temperature within a short period of time upon supply of electricity thereto, without being influenced by the temperatures of engine cooling water, etc. Meanwhile, in a short period of time (e.g., about 30 seconds) after startup of the engine, the temperature of engine cooling water and the temperature of the engine block rise only slightly. Therefore, within a period between the start of supply of electricity (start of temperature raising) and a point in time shortly after (e.g., about 30 seconds) startup of the engine, the other resistor portions such as the electricity supply member do not exhibit an increase in resistance due to the influence of the water temperature, etc. However, when this period has elapsed, the other resistor portions such as the electricity supply member exhibit an increase in resistance due to an increase in the water temperature or the like.

Thus, when the heater temperature of the heat generation section of the glow plug is increased to a high temperature within a few seconds (e.g., increased to 1300° C. within about 2 seconds), the resistance of the heat generation section increases greatly with the heater temperature. However, the resistances of the other resistor portions such as the electricity supply member do not increase very much as compared with those before the temperature raising. Accordingly, the resistance of the glow plug increases greatly as a whole during the temperature-raising period.

Meanwhile, in a stage where the engine maintains a high temperature after the startup, the resistance of the heat generation section is continuously maintained high. In contrast, the resistances of the other resistor portions such as the electricity supply member increase gradually, because the temperatures of the other resistor portions increase gradually as the temperature of the engine cooling water and the temperature of the engine block increase. That is, the resistance of the entire glow plug increases gradually, although its amount of increase is slight (e.g., at most about 2% of the entire resistance).

Incidentally, in the above-described invention, in the temperature-raising period; that is, during a period in which the resistance of the heat generation section changes, the overall resistance of the glow plug and the lead wire in the temperature-raising period (temperature-raising-period resistance) is acquired, and the overall target resistance of the glow plug and the lead wire is acquired on the basis of the overall resistance. Therefore, in order to continuously maintain the heater temperature of the heat generation section at a temperature near the target temperature during the maintaining period, there must be taken into consideration the phenomenon that the resistances of the other resistor portions such as the electricity supply member increase gradually with changes in the environmental conditions, such as the temperature of engine cooling water and the temperature of the engine block. That is, in order to maintain the heater temperature of the heat generation section at the target temperature, the target resistance must be changed gradually in accordance with increases in the resistances of the lead wire and the resistor portions other than the heat generation section.

In the glow plug electrification control apparatus of the present invention, the first environmental value acquisition means and the second environmental value acquisition means acquire the first environmental value and the second environmental value, respectively; and the environment correction means corrects the target resistance by reference to these values.

Thus, in the maintaining period, correction is performed in consideration of the phenomenon that the resistances of the lead wire and the other resistor portions such as the electricity supply member increase gradually with changes in the environmental conditions, such as the temperature of engine cooling water and the temperature of the engine block, whereby the overall resistance of the glow plug and the lead wire rises. Thus, a proper target resistance can be acquired at each point in time, and the heater temperature of the heat generation section can be properly maintained at the target temperature.

Notably, the environmental conditions refer to conditions around the glow plug which influence the temperatures of the lead wire and the other resistor portions such as the electricity supply member; specifically, the temperature of the engine head to which the glow plug is attached and the temperature of engine cooling water.

Accordingly, examples of the first environmental value and the second environmental value are these temperatures at each point in time.

Further, no limitation is imposed on the first environmental value acquisition means and the second environmental value acquisition means, so long as they can acquire the first environmental value and the second environmental value, respectively. Therefore, the first environmental value acquisition means and the second environmental value acquisition means may be constituted by a sensor for detecting the first environmental value or the second environmental value (e.g., the temperature of the engine head) or an input section which receives an output (the first environmental value, etc.) from a separately provided sensor.

Moreover, in the glow plug electrification control apparatus, preferably, the first environmental value acquisition means is a first water temperature acquisition means for acquiring, as the first environmental value, a first water temperature, which is a temperature of engine cooling water before or during the temperature-raising period; the second environmental value acquisition means is a second water temperature acquisition means for acquiring, as the second environmental value, a second water temperature, which is a temperature of the engine cooling water during the maintaining period; and the environment correction means is a water temperature correction means for correcting the target resistance by reference to the second water temperature and the first water temperature.

In the glow plug electrification control apparatus of the present invention, the first water temperature acquisition means and the second water temperature acquisition means acquire the first water temperature and the second water temperature of the engine cooling water; and the water temperature correction means corrects the target resistance by reference to these data.

Thus, in the maintaining period, a proper target resistance can be acquired at each point in time in consideration of the phenomenon that the overall resistance of the glow plug and the lead wire increases as a result of the resistances of the lead wire and the other resistor portions such as the electricity supply member gradually increasing with water temperature, whereby the heater temperature of the glow plug can be properly maintained at the target temperature.

Notably, the temperature of engine cooling water can be readily measured by use of a water temperature sensor. Further, in some engines (vehicles), the temperature of engine cooling water is measured by use of a water temperature sensor. Therefore, when the output of the water temperature sensor is received and utilized, the first water temperature and the second water temperature can be readily acquired without the necessity of separately providing a water temperature sensor. Further, advantageously, the degree of influence of a change in the water temperature on the resistance of the glow plug can be readily studied.

An example of a specific method which the water temperature correction means employs so as to correct the target resistance will be described. The target resistance Rm1 is corrected by use of the first water temperature WT1 [° C.], the second water temperature WT2 [° C.], and a water temperature correction coefficient Cb [mΩ/deg] and in accordance with a primary expression: Rm1=Rm1+Cb·(WT2−WT1), whereby a new corrected target resistance Rm1 is acquired.

The water temperature correction coefficient Cb is a coefficient which shows the degree of influence of a change in the temperature WT of engine cooling water on the target resistance Rm1 of the glow plug, etc. in a state where the heater temperature of the heat generation section is maintained high. That is, the water temperature correction coefficient Cb is a coefficient which provides an amount by which the target resistance Rm1, etc. would change when the water temperature WT rises 1 deg.

The above-described expression can be applied not only to the case where the second water temperature WT2 is higher than the first water temperature WT1 (WT2>WT1) but also to the case where the second water temperature WT2 becomes lower than the first water temperature WT1 (WT2<WT1).

Moreover, preferably, in the glow plug electrification control apparatus, the maintaining-period electrification control means comprises heat transfer correction means for correcting the target resistance in accordance with an increase in the maintaining-period resistance due to a temperature rise of resistor portions of the glow plug other than the heat generation section, which temperature rise occurs with a delay in relation to a temperature rise of the heat generation section.

As described above, when the temperature of the heat generation section rises, its resistance also increases. Further, the other resistor portions, such as the metallic shell, the electricity supply member within the glow plug, and the lead wire attached to the glow plug, also increase in resistance with the temperature.

Incidentally, when the heater temperature of the heat generation section of the glow plug is increased to a high temperature within about a few seconds, the resistance of the heat generation section increases greatly with the heater temperature. However, the resistances of the other resistor portions such as the electricity supply member and the lead wire do not increase very much as compared with those before the temperature raising.

However, due to heat transmitted from the heat generation section, the temperatures of the other resistor portions of the glow plug and the lead wire increase gradually with a delay in relation to the temperature rise of the heat generation section. Accordingly, even in the case where increases in the temperatures of engine cooling water and the engine block after startup of the engine are not taken into consideration, the overall resistance (maintaining-period resistance) of the glow plug and the lead wire increases gradually. Therefore, in order to maintain the heater temperature of the heat generation section at the target temperature, the target resistance must be changed gradually in accordance with the gradual increase in the overall resistance.

In the glow plug electrification control apparatus, the heat transfer correction means corrects the target resistance.

By virtue of this, in the maintaining period, a proper target resistance can be acquired at each point in time in consideration of an increase in the maintaining-period resistance due to transfer of heat from the heat generation section. Thus, the heater temperature of the heat generation section can be properly maintained at the target temperature.

Another means for solution is a glow plug electrification control system which comprises the glow plug electrification control apparatus according to any one of the claims, the glow plug, and the lead wire for connecting the electrification control apparatus and the glow plug together.

In the glow plug electrification control system, the above-described glow plug electrification control apparatus is provided. Therefore, even when a glow plug to be used differs in resistance from other glow plugs due to a characteristic variation, irrespective of the difference in characteristic, its heater temperature can be maintained the same.

DESCRIPTION OF REFERENCE NUMERALS

Figure 1:
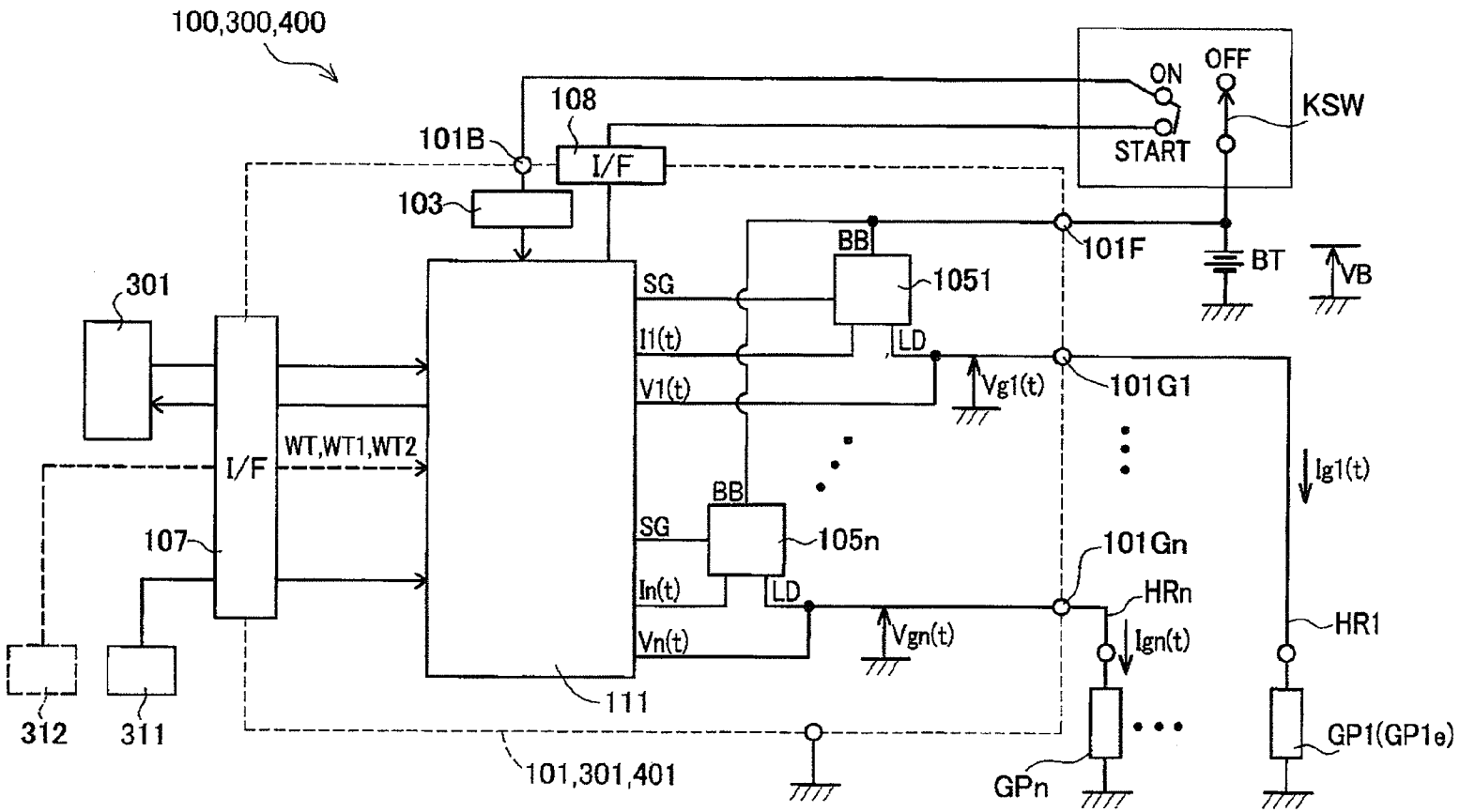
FIG. 1 is a circuit diagram showing a glow plug electrification control system and a glow plug electrification control apparatus according to Embodiment 1.

Reference numerals used to identify various features in the drawings include the following.

1: glow plug
2: sheathed heater
21: heat generation coil (heat generation section)
5: other resistor portions (excluding the heat generation coil of the glow plug)
100, 200, 300, 400: glow plug electrification control system
101, 201, 301, 401: glow plug electrification control apparatus
1051 to 105n, 2051 to 205n: switching elements
2061 to 206n: FETs
2071 to 207n: reference resistors
2081 to 208n: resistance division circuits
V1(*t*) to Vn(t): voltage signals (associated with glow plugs)
I1(*t*) to In(t): current signals (associated with glow plugs)
111, 211: main control section
312: water temperature sensor
CW: engine cooling water
WT: water temperature (of engine cooling water)
GP, GP1 to GPn: glow plugs
GP1: glow plug (first glow plug)
GP1*e*: glow plug (second glow plug) (after replacement)
Vg1(*t*) to Vgn(t): applied voltages (voltages applied to the glow plugs and lead wires)
Ig1(*t*) to Ign(t): currents (currents flowing through glow plugs and lead wires)
Rg, Rg(t), Rg1(*t*) to Rgn(t): resistances (of glow plugs and lead wires) (temperature-raising-period resistances; maintaining-period resistances)
Rg(0.5): 0.5 sec resistance (latest temperature-raising-period resistance;
temperature-raising-period resistance at the first predetermined timing)
Rg(1.0): 1.0 sec resistance (latest temperature-raising-period resistance)
Rg(2.0): 2.0 sec resistance (latest temperature-raising-period resistance)
Rm1 to Rmn: target resistances (of glow plugs and lead wires)
Tg, Tg1(*t*) to Tgn(t): heater temperatures (of heat generation coils (heat generation sections))
Tm: target temperature (of heat generation coils (heat generation sections))
P(t): electric power magnitude
Pb(t): reference electric power magnitude
EG: engine
S3, S4, S5 to S7, S31, S32, S61: temperature-raising-period electrification control means; supply power control means
S4: temperature-raising-period-resistance acquisition means
S3 to S5, S31, S32: reference-power-magnitude providing means
S3, S4, S6, S7, S31, S32: power magnitude control means
S3, S4, S31, S32: voltage-etc. acquisition means
S6, S61: duty ratio acquisition means
S7: pulse electrification means
SA1 to SA4, SA6, SB2, SB4, S12 to S20: maintaining-period electrification control means
S18: maintaining-period resistance acquisition means
SA6, SB4: target resistance acquisition means
S19: maintaining-period resistance control means
SA4, SB2: first environmental value acquisition means, first water temperature acquisition means
S14: second environmental value acquisition means, second water temperature acquisition means
WT: temperature of engine cooling water
WT1: first water temperature of engine cooling water (first environmental value)
WT2: second water temperature of engine cooling water (second environmental value)
Cb: water temperature correction coefficient
S16: environment correction means, water temperature correction means
S13: heat transfer correction means
Expression (1), (2), (3), (4): primary expressions
SA3, SB1: cranking detection means

DESCRIPTION OF THE PREFERRED EMBODIMENTS

Embodiment 1

An exemplary, non-limiting embodiment of the present invention will now be described with reference to the drawings.

Figure 2:
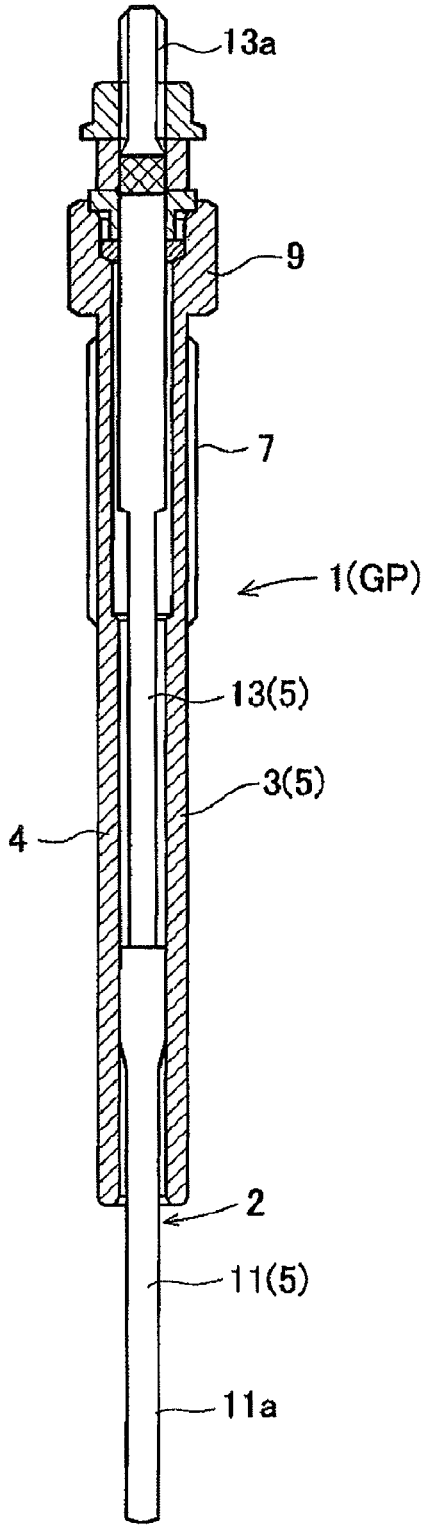
FIG. 2 is a sectional view of a glow plug used in Embodiments 1 and 2.
Figure 3:
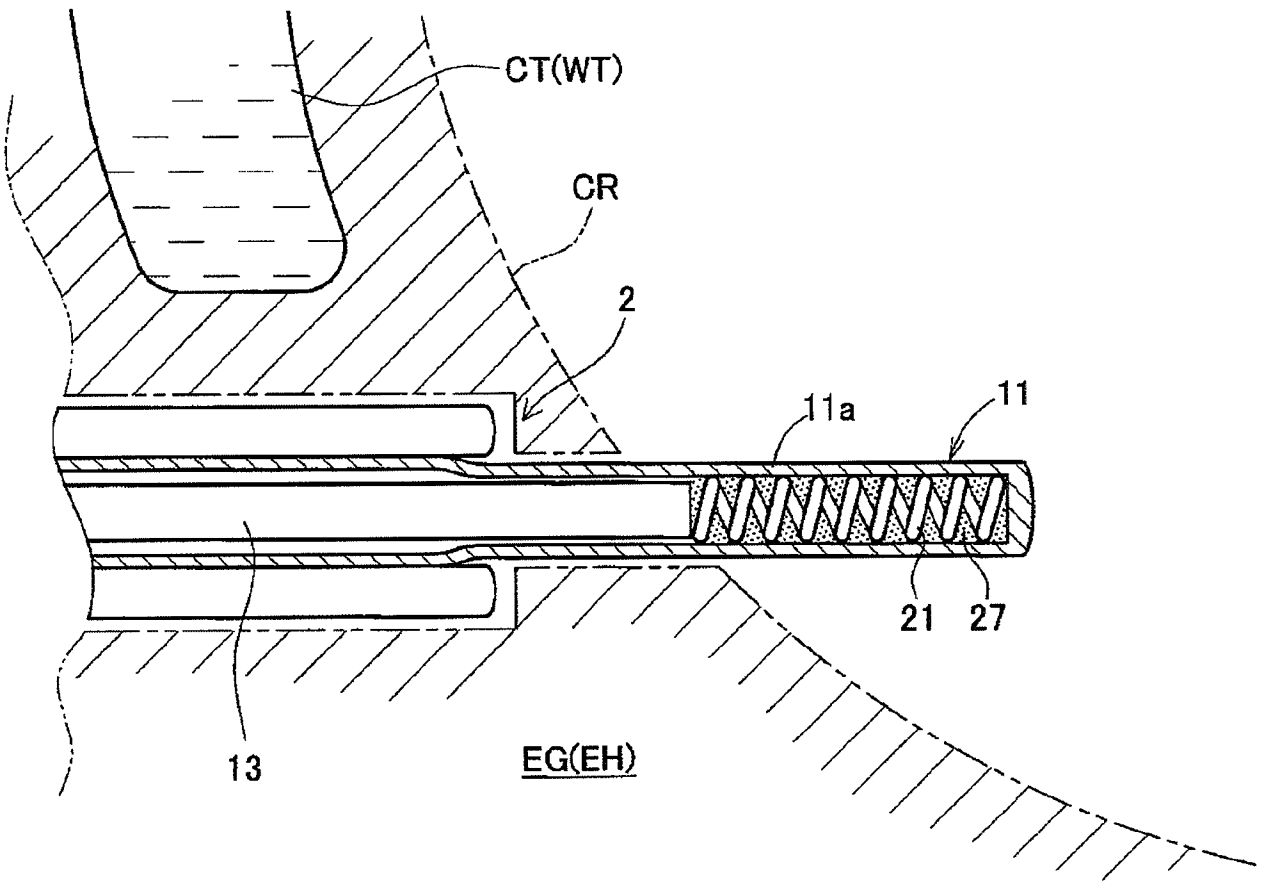
FIG. 3 is a partial sectional view relating to Embodiments 1 and 2 and showing a state in which the glow plug is attached to an engine.

First, a glow plug 1 (GP1 to GPn) subject to electrification control by a glow plug electrification control apparatus 101 of the present invention will be described. FIG. 2 shows a cross sectional view of the glow plug 1. FIG. 3 shows a state in which the glow plug 1 is mounted to an engine head EH of a diesel engine EG. The glow plug 1 includes a sheathed heater 2 configured as a resistance heater, and a metallic shell 3 disposed on the radially outer side of the sheathed heater 2. As shown in FIG. 3, the sheathed heater 2 includes a heat generation coil (heat generation section) 21 formed of a resistance wire. The heat generation coil 21, together with magnesia powder (insulating material containing MgO as a principle component) 27, is disposed, in a sealed condition, inside a sheath tube 11 having a closed tip end. As shown in FIG. 2, a distal end portion of a body portion 11*a* of the sheath tube 11 which accommodates the heat generation coil 21 projects from the metallic shell 3. As shown in FIG. 3, the heat generation coil 21 is electrically connected at its distal end with the sheath tube 11. However, the outer circumference of the heat generation coil 21 is isolated from the inner circumferential surface of the sheath tube 11 by means of the magnesia powder 27 present therebetween.

The heat generation coil 21 is formed of, for example, an Fe—Cr alloy or a Ni—Cr alloy.

Further, a bar-shaped electricity supply terminal rod 13 is inserted into the sheath tube 11 from its proximal end side. The distal end of the electricity supply terminal rod 13 is connected to the proximal end of the heat generation coil 21 by means of welding. Meanwhile, as shown in FIG. 2, a rear end portion of the electricity supply terminal rod 13 is formed into an external thread portion 13*a* on which an external thread is formed. Further, the metallic shell 3 is formed into a tubular shape and has an through hole 4 extending in an axial direction. The sheathed heater 2 is inserted into the through hole 4 from its one open end thereof and fixed to the metallic shell 3 in such a manner that a distal end portion of the sheath tube 11 projects a predetermined distance from the open end. A tool engagement portion 9 having a hexagonal cross section is formed on the outer circumferential surface of the metallic shell 3. When the glow plug 1 is attached to a diesel engine, a tool such as a torque wrench is engaged with the tool engagement portion 9. A thread portion 7 for attachment is formed on the distal end side of the tool engagement portion 9.

As shown in FIG. 3, the glow plug 1 is attached to a plug hole of the engine head EH of a diesel engine or the like by means of the thread portion 7 of the metallic shell 3. The distal end portion of the sheathed heater 2 projects into an engine combustion chamber CR over a predetermined length. The entire heat generation coil 21 is located within the engine combustion chamber CR.

In this glow plug 1, primarily the heat generation coil 21 produces its resistance. However, in addition thereto, other resistor portions 5 (the electricity supply terminal rod 13 and the metallic shell 3) of the glow plug 1 and the lead wire HR1 to HRn, which connect the glow plug 1 (GP1 to GPn) and the glow plug electrification control apparatus 101 and which supply electricity to the glow plug 1, produce a small resistance (e.g., about 10% of the entire resistance) as a whole.

Of these members, the resistance of the heat generation coil 21 has a positive correlation with its temperature, so that the resistance increases as the temperature rises. Also, the resistances of the other resistor portions 5 (the electricity supply terminal rod 13, and the metallic shell 3) have a positive correlation with their temperatures, so that their resistances increase as their temperatures rise. Accordingly, the resistance Rg of the entire glow plug 1 used in the present embodiment has a positive correlation with the heater temperature, so that the resistance Rg increases as the heater temperature rises. Notably, the resistance of each of the lead wires HR1, etc. has a positive correlation with its temperature, so that the resistance increases as the temperature rises.

However, the temperature of the heat generation coil 21 is raised to, for example, 1300° C. within a short period of time (e.g., about 2 seconds) upon supply of electricity thereto. Meanwhile, the temperatures of the other resistor portions 5 (including the electricity supply terminal rod 13, etc.) do not become very high as a whole, since the temperatures of the other resistor portions 5 are generally influenced by not only heat transferred from the heat generation coil 21, but also by the temperature of the engine head EH (see FIG. 3) located around the glow plug 1; as well as by the temperatures of engine cooling water, etc. As a result, the temperatures of the other resistor portions 5 are approximately equal to the temperatures of the engine cooling water, etc.

Further, although the temperature of the heat generation coil 21 is raised to a high temperature within a short period of time upon supply of electric current thereto, the temperatures of the lead wire HR1 and the other resistor portions 5, such as the electricity supply terminal rod 13, gradually rise due to heat transferred from the heat generation coil 21, over about 30 seconds with a delay in relation to the temperature rise of the heat generation coil 21. Therefore, the overall resistance of the glow plug 1 including the lead wire HR1, etc. also increases gradually.

Moreover, the temperature of the engine cooling water and the temperatures of the engine block, etc. hardly rise within a short period of time (e.g., about 30 seconds) after the startup of the engine. Therefore, after the short period of time (e.g., about 30 seconds) has elapsed after the startup of the engine, the resistances of the lead wire HR1, etc., and the other resistor portions 5, such as the electricity supply terminal rod 13, increase as the water temperature rises, so that the overall resistance of the glow plug 1, including the lead wire HR1, etc., also rises gradually.

Next, a glow plug electrification control system 100 and the glow plug electrification control apparatus 101 of the present embodiment will be described. FIG. 1 is a block diagram showing the electrical configurations of the glow plug electrification control system 100 and the glow plug electrification control apparatus 101 of the present embodiment. In addition to the glow plug electrification control apparatus 101, which will be described in detail below, the glow plug electrification control system 100 includes a plurality of (n) glow plugs 1 (GP1 to GPn) to which electric current is supplied from the glow plug electrification control apparatus 101 via the lead wires HR1 to HRn; a battery BT for supplying electric current to the glow plug GP1, etc.; and a key switch KSW for instructing supply of electric current to the glow plug GP1, etc., as well as operation of the engine (not shown in FIG. 1), and startup (cranking) of the engine. Further, the glow plug electrification control system 100 is connected to an engine control unit (hereinafter also referred to as "ECU") 301, an alternator 311, and a water temperature sensor 312 via an interface circuit 107.

A main control section 111 of the glow plug electrification control apparatus 101 receives via a power supply circuit 103 a stable operation voltage for signal processing. The power supply circuit 103 receives electricity from the battery BT via the key switch KSW and a terminal 101B. Accordingly, when the key switch KSW is turned to an ON position or a start position, electric power is supplied to the power supply circuit 103, so that the main control section 111 operates. Meanwhile, when the key switch KSW is turned to the OFF position, supply of electric power to the power supply circuit 103 is ended, and the main control section 111 stops the operation.

Notably, when the key switch KSW is turned to the start position, a signal indicating that the key switch KSW has been turned to the start position is fed to the main control section 111 via the interface circuit 108, whereby the main control section 111 can detect the cranking.

However, in a case where the key switch KSW, which has been turned OFF, is again turned ON before the temperatures of the glow plugs GP1 to GPn sufficiently drop, there arises a possibility that the glow plugs GP1, etc. are excessively heated, and wire breakage occurs.

In view of this, a holding circuit (not shown) composed of a capacitor, etc. is provided so as to maintain the drive of the main control section 111 until a certain period (e.g., about 60 seconds) elapses after the key switch KSW has been turned OFF and the temperatures of the glow plugs GP1, etc. drop sufficiently. Thus, in a case where the key switch KSW is gain turned ON within a short period of time after having been turned OFF (hereinafter referred to as "resupply of electricity"), the main control section 111 detects the resupply of electricity, and selects a power supply pattern in which the supply of power for raising the temperatures of the glow plugs GP1, etc. is restricted as compared with an ordinary case (hereinafter, such control is also referred to as "electricity resupply protection control"). Notably, in the case of the resupply of electricity, the main control section 111, whose drive has been continued from the previous operation, does not lose the contents of its memory, which would otherwise occur when the power source is turned off, and various data, including the target resistance, used in the previous operation are still memorized. Further, in the case of the resupply of electricity, an electricity resupply flag is set.

Further, electric current (or, simply, electricity) is supplied from the battery BT to n switching elements 1051 to 105n via a battery connection terminal 101F. In the present Embodiment 1, an FET having a current detection function (a product of Infineon Technologies AG; PROFET® part number BTS 6143 D) is used as the switching elements 1051 to 105n. The voltage VB of the battery BT is supplied to respective power supply terminals BB of the switching elements 1051 to 105n. Meanwhile, respective output terminals LD of the elements 1051 to 105n are connected to the plurality of (n) glow plugs GP1 to GPn via corresponding glow connection terminals 101G1 to 101Gn and the corresponding lead wires HR1 to HRn. Switching signals are supplied from the main control section 111 to respective input terminals SG of the elements 1051 to 105n. The elements 1051 to 105n turn ON and OFF in accordance with the voltage levels (high/low) of the switching signals so as to switch (ON/OFF) the supply of electric current to the glow plugs GP1 to GPn.

Further, current signals I1(*t*) to In(t) are supplied from the elements 1051 to 105n to the main control section 111. The current signals I1(*t*) to In(t) represent the respective magnitudes of currents Ig1(*t*) to Ign(t) flowing between the power supply terminals and the output terminals of the elements; i.e., flowing through the glow plugs GP1 to GPn, respectively, (accurately, currents flowing through the glow plugs GP1 to GPn and the lead wires HR1 to HRn; hereinafter these currents may be simply referred to as the currents flowing through the glow plugs GP1, etc.).

Moreover, in addition to the current signals I1(*t*) to In(t), voltage signals V1(*t*) to Vn(t) are supplied to the main control section 111. The voltage signals V1(*t*) to Vn(t) represent voltages Vg1(*t*) to Vgn(t) applied to the glow plugs GP1 to GPn at those times when the switching elements 1051 to 105n are on (accurately, voltages applied to the entire circuits including the glow plugs GP1 to GPn and the lead wires HR1 to HRn; hereinafter these voltages may be simply referred to as the voltages applied to the glow plugs GP1, etc.) The current signals I1(*t*) to In(t) and the voltage signals V1(*t*) to Vn(t) supplied to the main control section 111 are converted to digital data by means of unillustrated A/D converters as needed, and are processed within the main control section 111.

The main control section 111 is configured to communicate with the engine control unit 301, which is composed of a microcomputer, via the interface circuit 107. Further, the main control section 111 is configured to receive a drive signal from the alternator 311 so as to determine whether or not the alternator 311 generates electricity; i.e., whether or not the engine operates. Moreover, the temperature WT of engine cooling water (not shown in the drawings) measured by the water temperature sensor 312 is input to the main control section 111 via the interface circuit 107.

Figure 5:
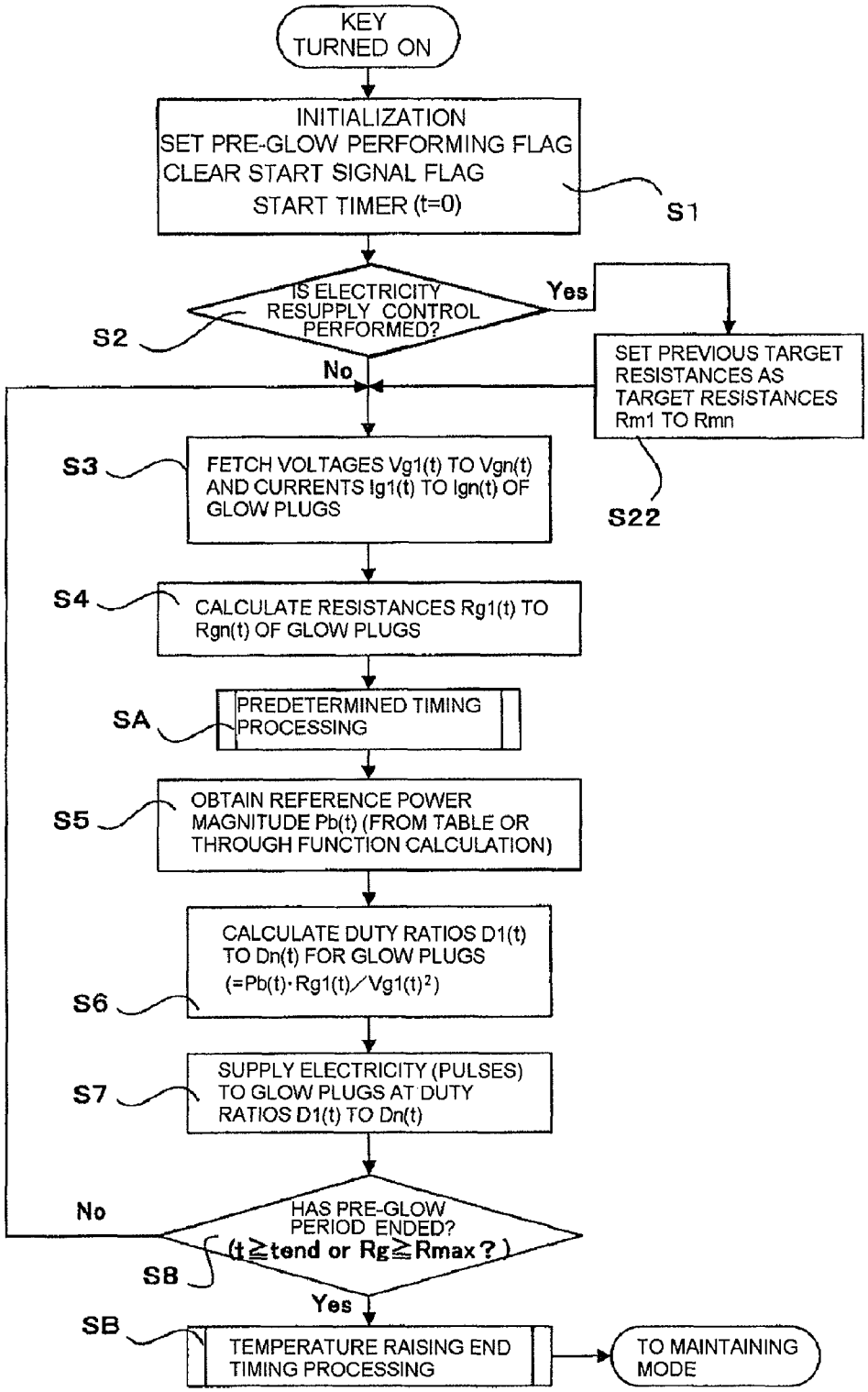
FIG. 5 is a flowchart showing electrification control performed by the glow plug electrification control apparatus according to Embodiment 1.

Next, electrification control performed for the glow plugs 1 (GP1 to GPn) by the glow plug electrification control system 100 and the glow plug electrification control apparatus 101 will be described with reference to a flowchart shown in FIG. 5.

In this electrification control, basically, the following operations are performed. First, when an operator turns the key switch KSW to the ON position, a pre-glow step, which is controlled by pre-glow means, is started. That is, electric power is supplied from the battery BT to the glow plugs 1 (GP1 to GPn), while the electric power supplied at each point in time is controlled. Thus, the temperature of the heat generation section 21 is raised for a predetermined short period of time (e.g., 2 seconds) to a first target temperature (e.g., 1300° C.) within a high temperature range.

Subsequently, the control apparatus proceeds to the next mode (maintaining mode) so as to maintain the high temperature. Specifically, in order that the resistances Rg1(*t*), etc. of the glow plugs GP1, etc. (specifically, the overall maintaining resistance of the glow plugs GP1, etc., including the lead wires HR1, etc. (hereinafter may be referred to as the maintaining resistance of the glow plugs GP1, etc.)) become equal to the corresponding target resistances, the control apparatus controls supply of electricity to the glow plugs GP1, etc. by means of PWM (pulse-width-modulation) control on the basis of the voltages Vg1(*t*) to Vgn(t) applied to the glow plugs GP1, etc., to thereby maintain the temperatures of the respective heat generation coils 21 at the corresponding target temperatures.

Notably, when the operator turns the key switch KSW to the start position in order to start the engine in the middle of the maintaining mode, the control apparatus moves to a cranking mode. Since the heat generation coil 21 is cooled by means of, for example, swirls generated as a result of cranking, preferably, the control apparatus performs the control in a mode different from the maintaining mode. Although this cranking mode will not be described in detail, the control apparatus PWM-controls the supply of electricity to the glow plugs 1 on the basis of the voltages Vg1(*t*) to Vgn(t) applied to the glow plugs GP1, etc., so as to suppress a drop in the temperature of the heat generation coil 21, to thereby improve startability of the engine.

Further, after the startup of the engine, the control apparatus proceeds to the maintaining mode so as to control the temperature of the heat generation coil 21 over a predetermined period of time (e.g., 180 seconds) to thereby maintain the temperature at a target temperature (e.g., 1300° C.).

Of these modes, the present invention relates to the pre-glow mode for quickly raising the temperature of the heat generation coil 21, and to the maintaining mode. Therefore, control of these modes will be described in detail, and other modes will be described briefly.

First, when the operator turns the key switch KSW to the ON position, electric power is supplied to the main control section 111 (see FIG. 1). Specifically, a drive voltage is applied from the battery BT to the main control section 111 via the key switch KSW, the power supply connection terminal 101B, and the power supply circuit 103, whereby the main control section 111 starts to operate in a predetermined procedure.

First, in step S1, the main control section 111 initializes its program. Specifically, a pre-glow performing flag (a flag indicating that a pre-glow step is currently performed) is set. Meanwhile, a start signal flag (a flag indicating that the key switch KSW has been turned to the start position) is cleared. Further, a timer for counting the elapsed time t is started after the elapsed time t is set to 0.

Next, in step S2, the main control section 111 determines whether or not the present supply of electricity is a resupply of electricity. Specifically, the main control section 111 determines where or not the electricity resupply flag is set.

When the main control section 111 makes a "Yes" determination; i.e., the present supply of electricity is resupply of electricity, the main control section 111 proceeds to step S22 so as to use, as the present target resistances Rm1 to Rmn, the previous target resistances stored in the main control section 111. As described above, in the case of the resupply of electricity, the main control section 111 has been driven continuously from the previous operation. The contents of the memory due to turn off of the power source are prevented from being lost, and the target resistances used in the previous operation are stored. Therefore, the stored previous target resistances are used as the present target resistances Rm1 to Rmn. Since the present supply of electricity is a resupply of electricity, the glow plugs GP1, etc. are in a state in which they have already been heated to some degree. Therefore, if temperature-raising-period resistances Rg1(*t*) to Rgn(t) (t=0.5, 1.0, 2.0, 3.3 sec) at predetermined timings, described below, are acquired, proper target resistances Rm1 to Rmn cannot be obtained using the graphs of FIGS. 10, etc. or the regression equations (1), etc. Therefore, the stored target resistances used at the time of the previous operation are used again. Reuse of the previous target resistance realizes more accurate control as compared with the case where the previous target resistances are not used. By virtue of this control, even when the present supply of electricity is a resupply of electricity, the heater temperatures Tg1(*t*) to Tgn(t) of the glow plugs GP1, etc. can be maintained at the same target temperature Tm (e.g., 1300° C.) irrespective of variations of the respective Rg1(*t*), etc. of the glow plugs GP1, etc. used.

After step S22, the main control section 111 proceeds to step S3, and repeatedly performs the processing of steps S3 to S8 (which are described below).

Meanwhile, when the main control section 111 makes a "No" determination in step S2; i.e., the present supply of electricity is not a resupply of electricity, the main control section 111 proceeds to step S3. In this case, a long period of time has elapsed after the previous operation of the engine, and the temperatures of the glow plugs (the heat generation coils 21) are considered to have dropped sufficiently. Therefore, no problem arises even if electric current is supplied to the glow plugs, as described below, so as to quickly raise the temperatures thereof.

In step S3, at a timing when the switching elements 1051 to 105n are on, the main control section 111 fetches, as voltage signals V1(*t*) to Vn(t), the voltages Vg1(*t*) to Vgn(t) applied to the glow plugs GP1, etc., and also fetches, as current signals I1(*t*) to In(t), currents Ig1(*t*) to Ign(t) flowing through the glow plugs GP1, etc.

In step S4, the main control section 111 calculates the resistances Rg1(*t*) to Rgn(t) of the glow plugs GP1, etc. at the elapsed time t from the start of electrification; i.e., one or more predetermined timings (in the present example, three timings (t=0.5, 1.0, and 2.0 sec)) (Rg1(*t*)=Vg1(*t*)/Ig1(*t*), . . . , Rgn(t)32 Vgn(t)/Ign(t)). Notably, in step SB2 to be described below, the resistances (temperature-raising resistances) Rg1(3.3) to Rgn(3.3) at the elapsed time $t=t_{end}$ (specifically, t=3.3 sec) are calculated and acquired. Notably, accurately, the temperature-raising-period resistances Rg1(*t*) to Rgn(t) are the overall temperature-raising-period resistances of the glow plugs GP1 to GPn, including the lead wires HR1 to HRn.

The main control section 111 then proceeds to step SA. In the subroutine shown in FIG. 6 and corresponding to this step SA, predetermined timing processing is performed. First, in step SA1, the main control section 111 determines whether or not the elapsed time t counted by the timer reaches 0.5 sec. When the main control section 111 makes a "Yes" determination (that is, when t=0.5 sec), the main control section 111 proceeds step SA4, while skipping steps SA2 and SA3, described below. The above-described processing is performed so as to calculate the target resistances of the glow plugs GP1, etc. at the timing of t=0.5 sec irrespective of whether cranking is performed or not.

Meanwhile, the main control section 111 makes a "No" determination (t≠0.5 sec), the main control section 111 proceeds step SA2.

In this step SA2, the main control section 111 determines whether or not the elapsed time t counted by the timer reaches 1.0 sec or 2.0 sec.

When the main control section 111 makes a "Yes" determination (that is, when the elapsed time t counted by the timer has reached 1.0 sec or 2.0 sec), the main control section 111 proceeds to step SA3. When the main control section 111 makes a "No" determination (that is, when the time t counted by the timer is neither 1.0 sec nor 2.0 sec), the main control section 111 returns to the main routine while skipping the steps SA3 to SA6.

In step SA3, the main control section 111 determines whether the engine is being cranked, specifically, the start signal flag is set. When the start signal flag is not set (No), the main control section 111 proceeds to step SA4, and calculates and updates the target resistances Rm1, etc., which is described below, in step SA6.

When the flag is set (Yes), the main control section 111 returns to the main routine while skipping the steps SA4 to SA6. By virtue of the above-described operation, even in the case where the time t counted by the timer has reached 1.0 sec or 2.0 sec, the calculation and updating of the target resistances Rm1, etc., which will be described next, are not performed if cranking is being performed, and the target resistances Rm1, etc. acquired when t=0.5 sec are maintained.

Notably, when an operator turns the key switch KSW to the start position so as to start cranking, a signal is input to the main control section 111 via the interface circuit 108. On the basis of this signal, unillustrated interruption processing sets the start signal flag.

In step SA4, the main control section 111 acquires, updates, and stores a first water temperature WT1 of engine cooling water. The main control section 111 then proceeds to step SA5 so as to determine whether or not the present supply of electricity is a resupply of electricity (whether or not the electricity resupply flag is set). When the present supply of electricity is not a resupply of electricity (No), the target resistances Rm1 to Rmn are not set. Therefore, the main control section 111 proceeds to step SA6 so as to calculate, update, and store the target resistances Rm1 to Rmn of the glow plugs GP1 to GPn (more accurately, the glow plugs GP1 to GPn and the lead wires HR1 to HRn) in the maintaining mode from the corresponding temperature-raising-period resistances Rg1(*t*) to Rgn(t) (t=0.5, 1.0, or 2.0 sec). The main control section 111 then returns to the main routine.

Accordingly, in the present embodiment, in addition to the first water temperature WT1, the target resistances Rm1 to Rmn are updated to the newest values every time one of the predetermined timings (in the present example, t=0.5, 1.0, or 2.0 sec) has come. That is, the target resistances Rm1 to Rmn are obtained from the latest temperature-raising-period resistances (Rg1(0.5), etc., Rg1(1.0), etc. or Rg1(2.0), etc.) among the temperature-raising-period resistances at the predetermined timings. As described below, the most adequate target resistances can be obtained from the temperature-raising-period resistances obtained latest.

When the main control section 111 makes a "Yes" determination in step SA5 (that is, when the present supply of electricity is a resupply of electricity), the main control section 111 returns to the main routine while skipping step SA6; i.e., without newly acquiring the target resistances Rm1, etc, because of the following reason. As described above, in this case, the glow plugs are in a somewhat heated state from the beginning, and adequate target resistances Rm1, etc. cannot be obtained from the temperature-raising-period resistances Rg1(*t*), etc.

Notably, in the case where the operator turns the key switch KSW to the start position so as to start cranking (when a "Yes" determination is made in step SA1), at the timing when the time t counted by the timer has reached 0.5 sec, the main control section 111 acquires the target resistances Rm1, etc. in accordance with the processing of steps SA4 and SA6 (while skipping step SA3) irrespective of whether or not cranking is currently performed (in the case where electricity resupply control is not performed), because the target resistance Rm1 must be obtained at least one time, the temperature-raising-period resistances Rg1(0.5) to Rgn(0.5) acquired in step S4 reflect the influence of variations in the resistances of the glow plugs GP1, etc. to some degree, even though the temperature-raising-period resistances have changed due to the influence of cranking.

Meanwhile, at the timing when the time t is 1.0 sec or 2.0 sec, the main control section 111 calculates new target resistances Rm1, etc. for update if cranking is not being performed ("No" in step SA3), but does not calculate new target resistances Rm1, etc. for update if cranking is being performed ("Yes" in step SA3), because the following reason. Since the heater temperature Tg1 of the heat generation coil 21 drops due to the influence of swirls and fuel injection associated with cranking, the target resistances Rm1, etc. cannot be obtained properly. In view of this, the target resistances Rm1, etc. already obtained before start of cranking (or at t=0.5 sec) are utilized as being effective.

A method for calculating the target resistances Rm1 to Rmn from the temperature-raising-period resistances Rg1(*t*) to Rgn(t) will be described below.

Next, in step S5 (see FIG. 5), the main control section 111 obtains a reference power magnitude Pb(t) at the present (at the elapsed time t from the start of electrification). In the present embodiment, specifically, a table which correlates the relation between the elapsed time t and the reference power magnitude Pb(t) is previously prepared (stored in the main control section 111), and a reference power magnitude Pb(t) corresponding to the elapsed time t is obtained.

In the present embodiment, the relation between the elapsed time t and the reference power magnitude Pb(t) is obtained as follows. First, of the glow plugs 1 whose resistances Rg (including those of the lead wires HR1, etc.) fall within an allowable range (e.g., 180 to 220 mΩ), a glow plug (sample) having a relatively high resistance (e.g., 215 mΩ) close to the upper limit is selected and attached to a predetermined engine by use of the lead wires. Subsequently, a battery voltage VB is set to 8.0 V, which is the lower limit for driving the glow plug, and a switching element corresponding to the switching element 1051, etc. is continuously turned on. That is, the duty ratio is set to 100%. As a result, the temperature of the sample glow plug rises, and reaches a predetermined temperature (e.g., 1300° C.) at an elapsed time $t_{end}$.

However, the temperature rises at a slower speed (i.e., the time required to reach a predetermined temperature is longer) as compared with a case where the battery voltage VB is higher or a case where a glow plug 1 having a lower resistance Rg is used. In other words, the temperature rising speed is relatively slow when the battery voltage VB is small due to its variation or when the glow plug 1 having a lower resistance Rg is employed, similar to the case where the glow plug 1 is energized at a duty ratio set to 100%, which also causes a slow temperature rising speed.

Further, as the temperature rises, the resistance of the heat generation coil 21 increases, so that the current flowing through the glow plug 1 decreases. Consequently, the magnitude of electric power supplied to the glow plug decreases as the elapsed time t increases. This change is shown in FIG. 4.

Figure 4:
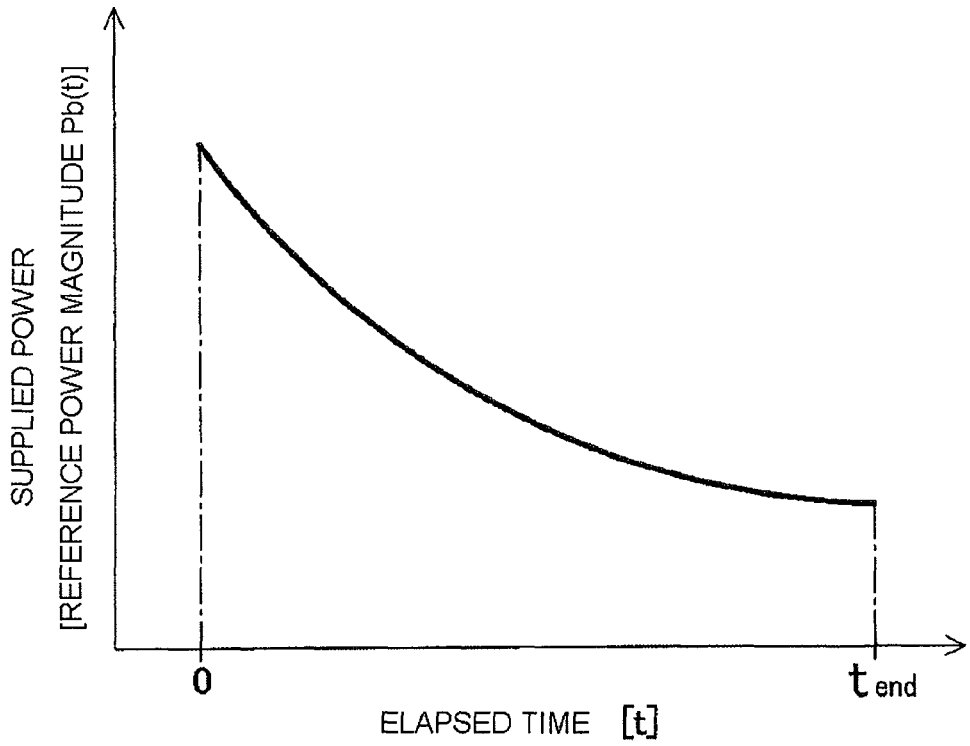
FIG. 4 is a graph schematically showing the relation between the elapsed time t and electric power supplied to the sample glow plug for the case where a voltage is continuously applied to the glow plug.

In the present embodiment, a curve shown in FIG. 4 is used as a curve which represents a change in the reference power magnitude Pb(t), and each time t as well as a value of the reference power magnitude Pb(t) at that time are stored in a table.

Thus, except for a case where the battery voltage VB is lower than 8.0 V and the resistances of the glow plugs GP1, etc. are greater than 215 mΩ, at each elapsed time t, electric power whose magnitude P(t) is equal to the corresponding reference power magnitude Pb(t) can be supplied to the glow plugs GP1, etc. through performance of PWM control at a duty ratio of less than 100%.

Notably, in the present embodiment, the reference power magnitude Pb(t) is obtained from the table stored in the main control section 111 by use of the elapsed time t. However, the curve shown in FIG. 4 may be stored as a function which provides the reference power magnitude Pb(t). In such a case, the reference power magnitude Pb(t) is calculated on the basis of the value of the elapsed time t when necessary.

Further, the present embodiment exemplifies a case where when the elapsed time t is given, the reference power magnitude Pb(t) can be univocally obtained from the table. However, the reference power magnitude Pb(t) may be selected in consideration of other factors. For example, the embodiment may be modified in such a manner as to obtain other factors, such as ambient temperature, engine water temperature, and elapsed time from a previous operation, separately from the elapsed time t, and obtain the reference power magnitude Pb(t) from the elapsed time t and the engine water temperature. Alternatively, the embodiment may be modified in such a manner as to obtain a provisional reference power magnitude corresponding to the elapsed time t and then correct the provisional reference power magnitude on the basis of values representing other factors such as ambient temperature and engine water temperature, to thereby obtain a true reference power magnitude Pb(t).

Next, in step S6, the main control section 111 calculates duty ratios D1(*t*) to Dn(t) for the glow plugs GP1 to GPn.

Specifically, the main control section 111 obtains the duty ratios D1(*t*) to Dn(t) from the previously obtained reference power magnitude Pb(t), applied voltages Vg1(*t*) to Vgn(t), and resistances Rg1(*t*) to Rgn(t) in accordance with equations $D1(t)=Pb(t)\cdot Rg1(t)/Vg1(t)^2$, . . . , $Dn(t)=Pb(t)\cdot Rgn(t)/Vgn(t)^2$.

Notably, the duty ratios D1(*t*) to Dn(t) may be obtained from the previously obtained reference power magnitude Pb(t), the applied voltages Vg1(*t*) to Vgn(t), and the currents Ig1(*t*) to Ign(t) in accordance with equations $$D1(t)=Pb(t)/(Vg1(t)\cdot Ig1(t)), \ldots, Dn(t)=Pb(t)/(Vgn(t)\cdot Ign(t)).$$

Subsequently, in step S7, the switching elements 1051 to 105n are turned on and off at the duty ratios D1(*t*) to Dn(t).

With this operation, even when the temperature-raising-period resistances Rg1(*t*) to Rgn(t) of the glow plugs GP1 to GPn differ from one another, electric power whose magnitude P(t) is equal to the reference power magnitude Pb(t) is supplied to each of the glow plugs GP1 to GPn. That is, at each elapsed time t after the start of electrification, electric power of the same magnitude P(t) is supplied to each of the glow plugs GP1 to GPn. Therefore, conceivably, at each point in time, the respective heat generation coils 21 generate quantities of heat that approximately correspond to the same energy. Therefore, under the assumption that the glow plugs GP1 to GPn are the same in terms of heat dissipation, the respective heat generation coils 21 have substantially the same heater temperature, so that the temperatures of the respective heat generation coils 21 can be raised to follow the same temperature curve.

Notably, the magnitude of electric power supplied to the glow plugs GP1 to GPn (more accurately, the glow plugs and the lead wires) is changed to follow the curve shown in FIG. 4. Therefore, when the elapsed time t reaches the end time $t_{end}$, the temperatures of the glow plugs GP1 to GPn each reach a predetermined temperature (e.g., 1300° C.).

Subsequently, in step S8, the main control section 111 determines whether or not the pre-glow period ends. Specifically, the main control section 111 determines whether or not the elapsed time t counted by the timer becomes equal to or greater than the end time $t_{end}$ (e.g., 3.3 sec), or whether or not any one of the temperature-raising-period resistances Rg1(*t*)

to Rgn(t) (in FIG. 5, etc., abbreviated to Rg) of the glow plugs GP1, etc. becomes equal to or greater than a predetermined resistance upper limit Rmax (e.g., Rmax=780 mΩ).

When a "No" determination is made; i.e., the pre-glow period has not yet ended ($t<t_{end}$, and all of Rm1(*t*), etc. are smaller than Rmax (Rg1(*t*)<Rmax, . . . , Rgn(t)<Rmax)), the main control section 111 returns to step S3.

Meanwhile, when a "Yes" determination is made; i.e., the pre-glow period has ended ($t \geqq t_{end}$, or at least one of the temperature-raising-period resistances Rg1(*t*) to Rgn(t) becomes equal to or greater than Rmax), after ending the temperature raising end timing processing of step SB, the main control section 111 ends the processing in the above-described pre-glow mode, and proceeds to the next mode.

The present embodiment exemplifies a case where the common resistance upper limit Rmax (Rmax=780 mΩ) is used for the glow plugs GP1, etc. However, the resistance upper limit Rmax may be individually set for each glow plug in consideration of variations in characteristics among the glow plugs.

Further, in the present embodiment, the main control section 111 does not determine whether or not the resistances of the glow plugs GP1, etc. are anomalous (wire breakage or formation of short circuit). However, failure diagnosis for the glow plugs may be performed at an appropriate time; e.g., after the resistances Rg1(*t*), etc. are calculated in step S4. Specifically, the present embodiment may be modified as follows. The determination as to whether nor anomaly (e.g., breakage of a wire or formation of a short circuit) has occurred in the glow plugs GP1, etc. is performed on the basis of the calculated values of resistances Rg1(*t*), etc. When any one of the glow plugs is determined to be anomalous, supply of electricity to that glow plug is stopped, and the processing of each step (subsequent steps SA, etc.) is performed for the remaining glow plugs.

Figure 7:
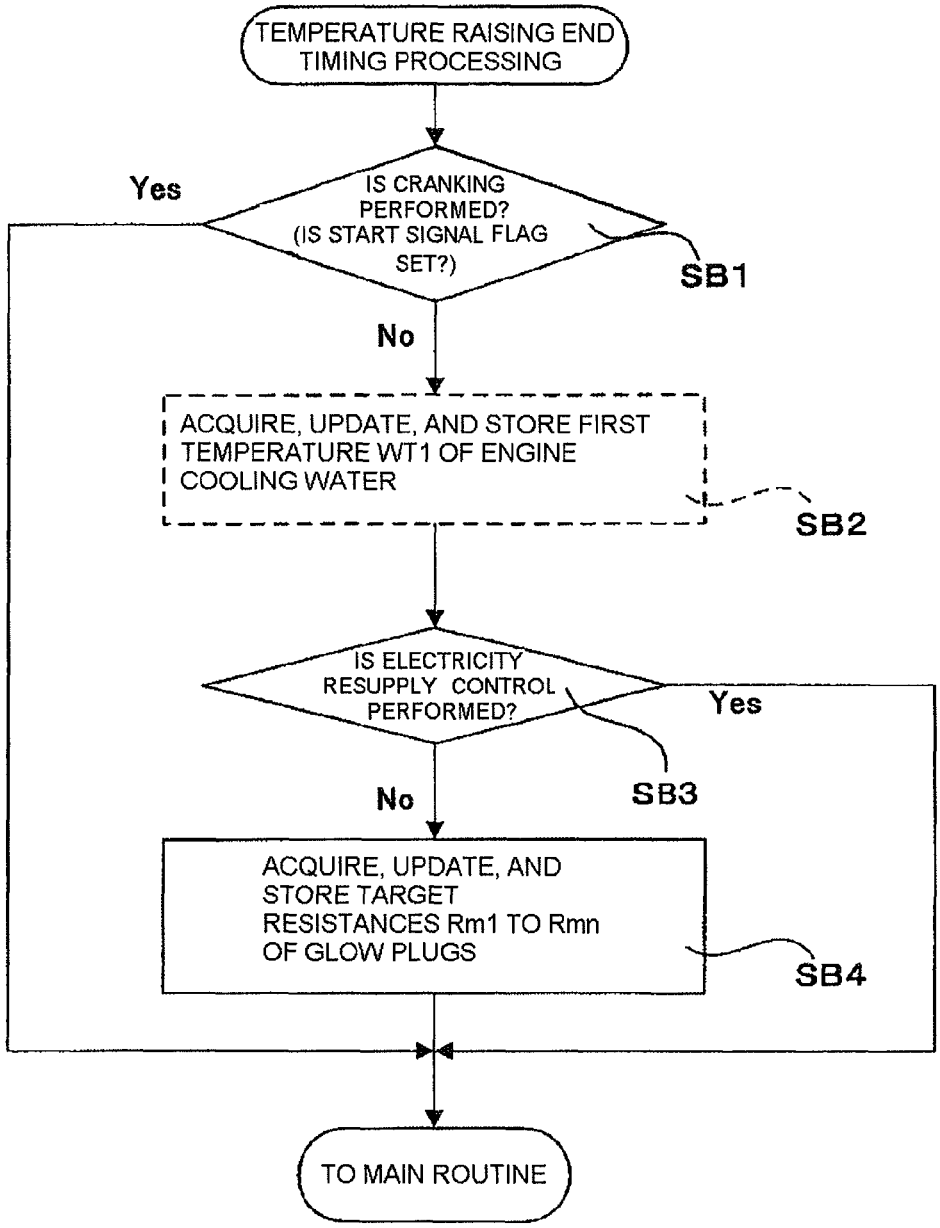
FIG. 7 is a flowchart showing the details of a subroutine for temperature raising end timing processing, in the electrification control of Embodiment 1.

In a subroutine shown in FIG. 7 and corresponding to step SB, the temperature raising end timing processing is performed. Specifically, in step SB1, the main control section 111 determines whether or not the engine is being cranked, specifically, the start signal flag is set. When the start signal flag is not set (No), the main control section 111 proceeds to step SB2. When the flag is set (Yes), the main control section 111 returns to the main routine while skipping the steps step SB2 to SB4. By virtue of the above-described operation, even in the case where the time t counted by the timer has reached 3.3 sec, the calculation and updating of the target resistances Rm1, etc. are not performed if cranking is being performed.

Subsequently, in step SB2, the main control section 111 acquires, updates, and stores the first water temperature WT1 of engine cooling water at that point in time (t=3.3 sec). Further, the main control section 111 then proceeds to step SB3 so as to determine whether or not the present supply of electricity is a resupply of electricity (whether or not the electricity resupply flag is set). When the present supply of electricity is not a resupply of electricity (No), the target resistances Rm1 to Rmn are not set. Therefore, the main control section 111 proceeds to step SB4 so as to calculate, update, and store the target resistances Rm1 to Rmn of the glow plugs GP1 to GPn in the maintaining mode from the corresponding resistances (the temperature-raising-period resistances Rg1(*t*) to Rgn(t) (t=3.3 sec). The main control section 111 then returns to the main routine.

When the main control section 111 makes a "Yes" determination in SB3 (that is, when the present supply of electricity is a resupply of electricity), the main control section 111 returns directly to the main routine by skipping step SB4; i.e., without newly acquiring the target resistances Rm1, etc.

A method for calculating the target resistances Rm1 to Rmn from the temperature-raising-period resistances Rg1(*t*) to Rgn(t) is described below.

Figure 8:
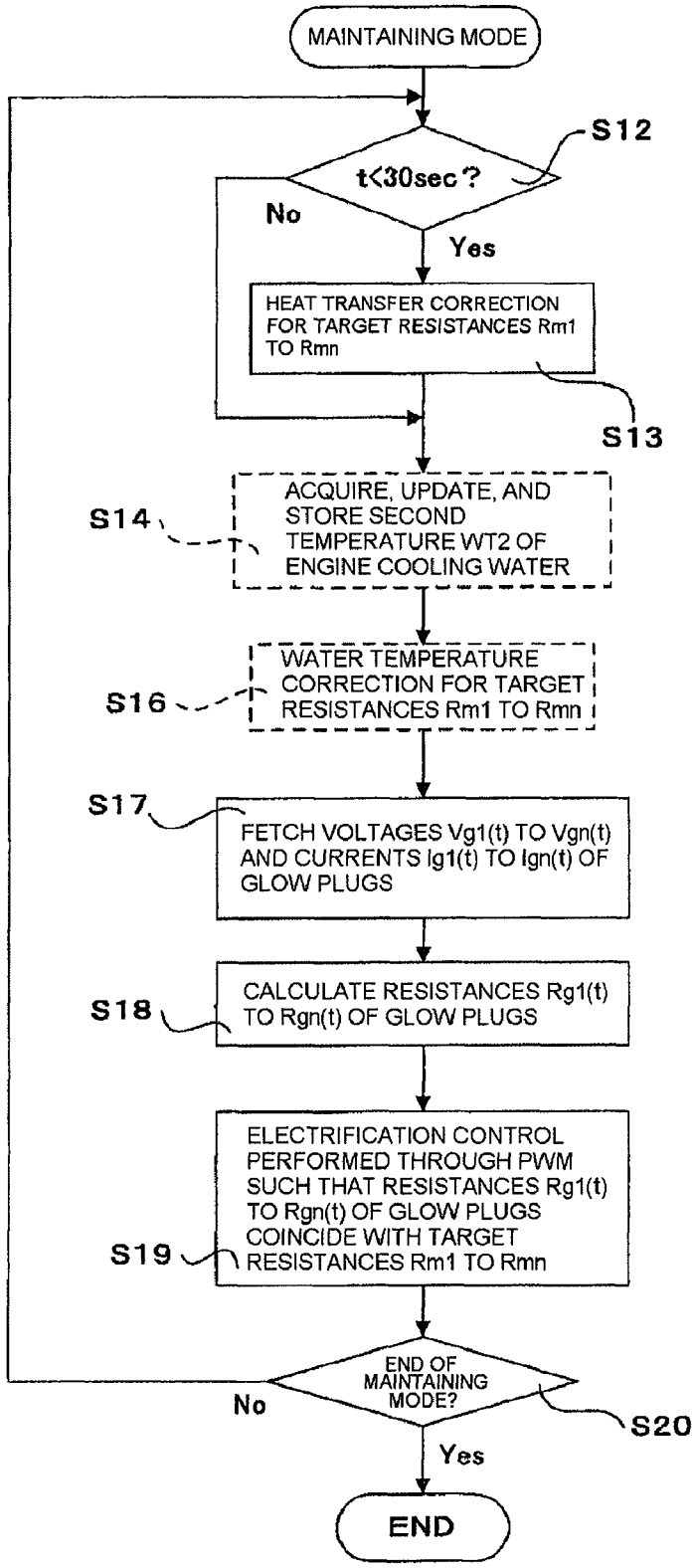
FIG. 8 is a flowchart showing the details of a maintaining mode, in the electrification control of Embodiment 1.

After that, the main control section 111 moves to the next mode (maintaining mode: see FIG. 8).

First, a method for calculating the target resistances Rm1 to Rmn from the temperature-raising-period resistances Rg1(*t*) to Rgn(t) will be described with reference to FIGS. 9 to 13.

Sample glow plugs (n=18) having the same part number were prepared with and a thermocouple attached to the heat generation section so as to measure the heater temperature. The 18 sample glow plugs were selected from a large number of glow plugs of that part number so that the resistances (0.22 to 0.253 Ω) of the selected glow plugs, measured at room temperature (25° C.) (which correspond to pre-electrification resistances Rg(0) at 25° C. as described below), vary to the greatest extent within the range (0.215 to 0.255 Ω) of tolerance (permissible tolerance) of about ±10% from the designed center value (0.235 Ω) of the glow plugs. Each of these glow plugs was attached to the engine head EH, and electricity was supplied thereto in a state where the glow plugs and the engine head EH were held in a thermostatic chamber. The heater temperature Tg of each glow plug was raised to 1300° C. over 3.3 sec, and maintained at 1300° C. The resistance of each glow plug after elapse of 60 sec (called 1300° C. resistance Rg1300) was measured. Notably, the test was performed for each glow plug, while the temperature of the thermostatic chamber (environmental temperature) was changed to four different temperatures; i.e., 0, 25, 80, and 125° C. Further, the resistance of each glow plug was measured in a state in which a lead wire corresponding to the lead wire HR1, etc. was connected to the glow plug, and the overall resistance including the resistance of the lead wire was measured as the resistance of the glow plug.

Figure 9:
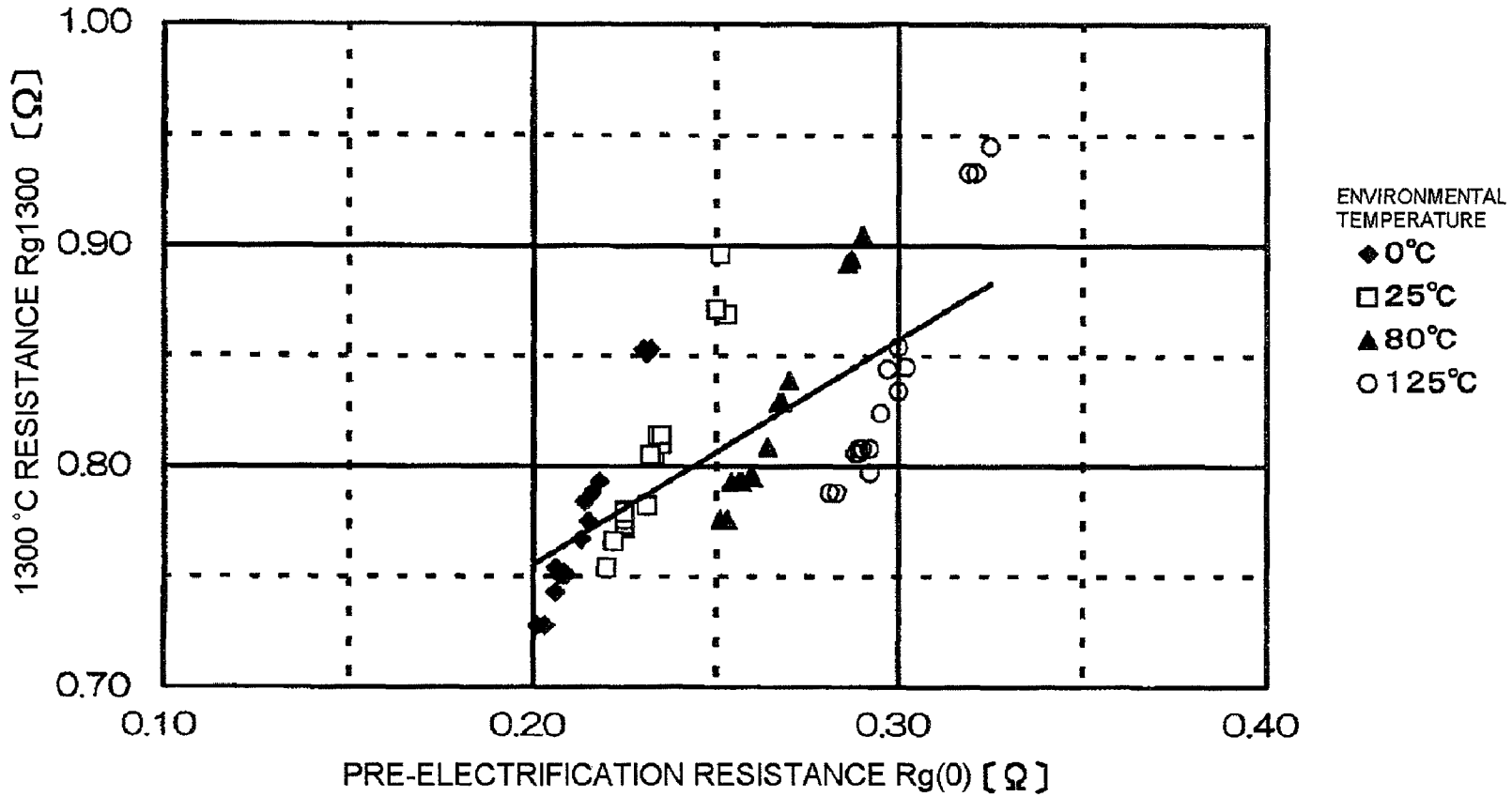
FIG. 9 is a graph showing the relation between the pre-temperature raising resistances Rg(0) and the 1300° C. resistances of glow plugs used in Embodiment 1.

FIG. 9 shows test results; i.e., the relation between the resistances of the glow plugs before supply of electricity thereto (t=0) (called pre-electrification resistances Rg(0)) and 1300° C. resistances Rg1300 of the glow plugs whose heater temperatures were maintained at 1300° C.

Figure 10:
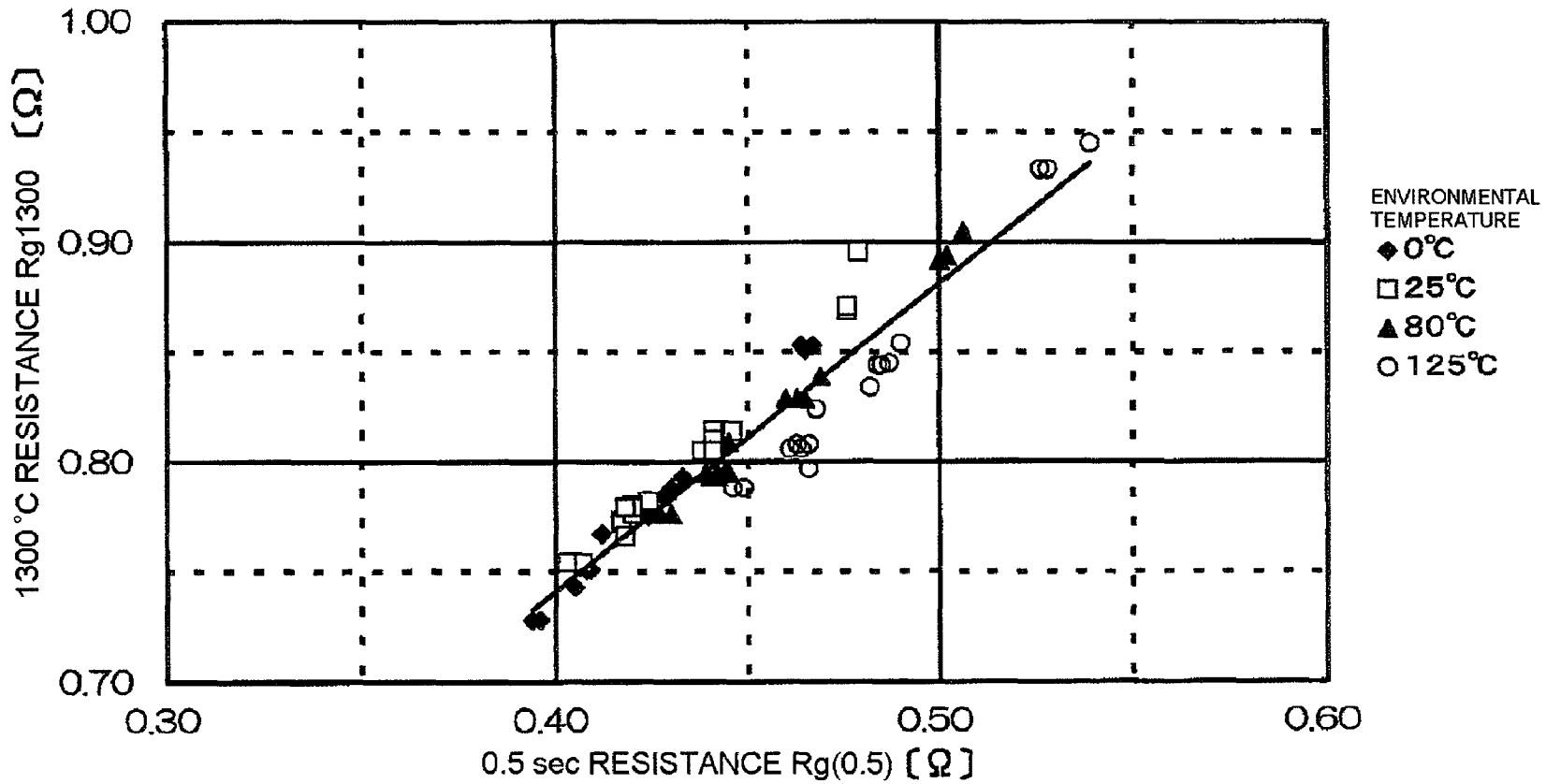
FIG. 10 is a graph showing the relation between the temperature-raising-period resistances Rg(0.5) at the elapsed time t=0.5 sec and the 1300° C. resistances of glow plugs used in Embodiment 1.
Figure 11:
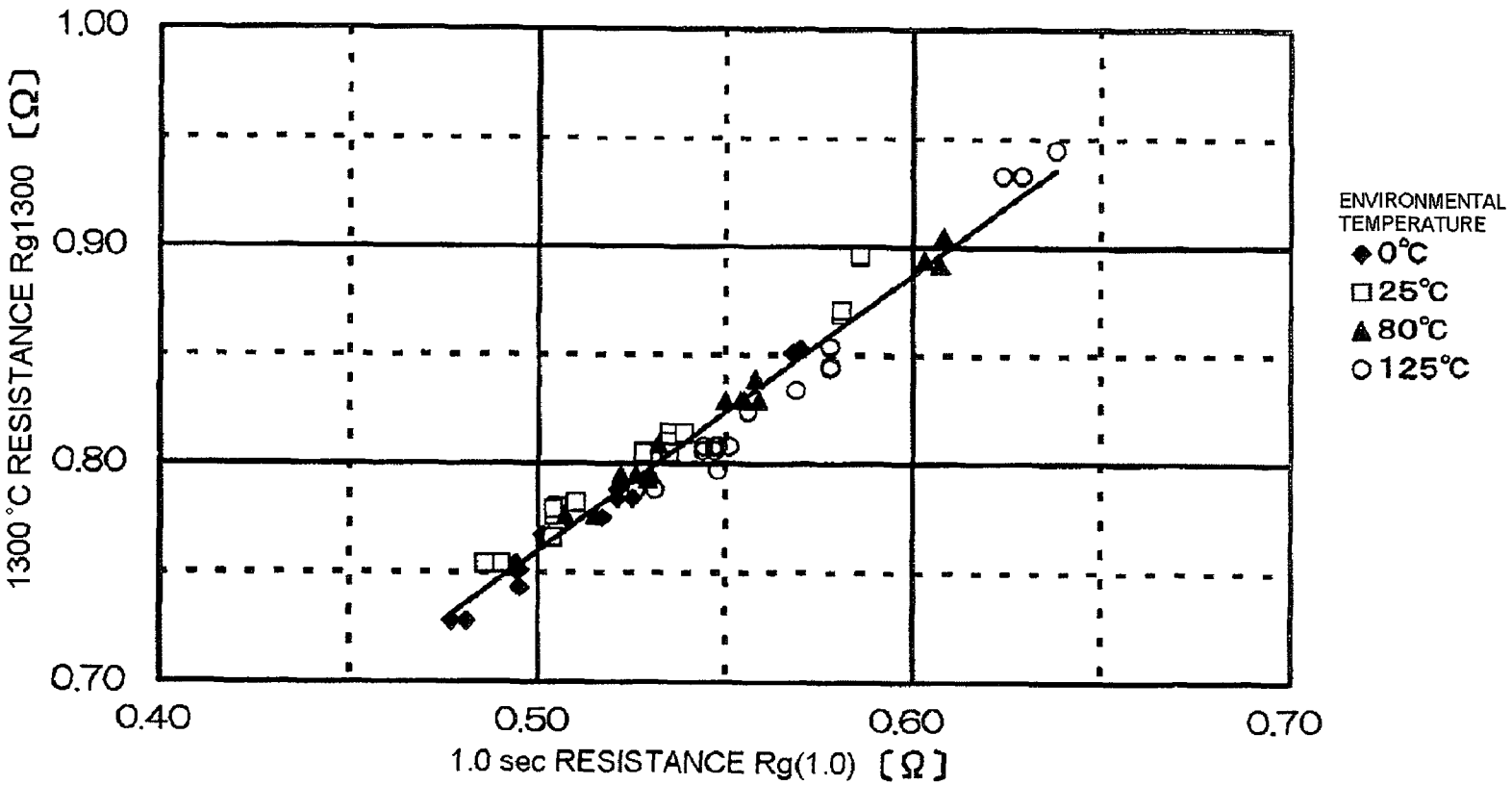
FIG. 11 is a graph showing the relation between the temperature-raising-period resistances Rg(1.0) at the elapsed time t=1.0 sec and the 1300° C. resistances of glow plugs used in Embodiment 1.
Figure 12:
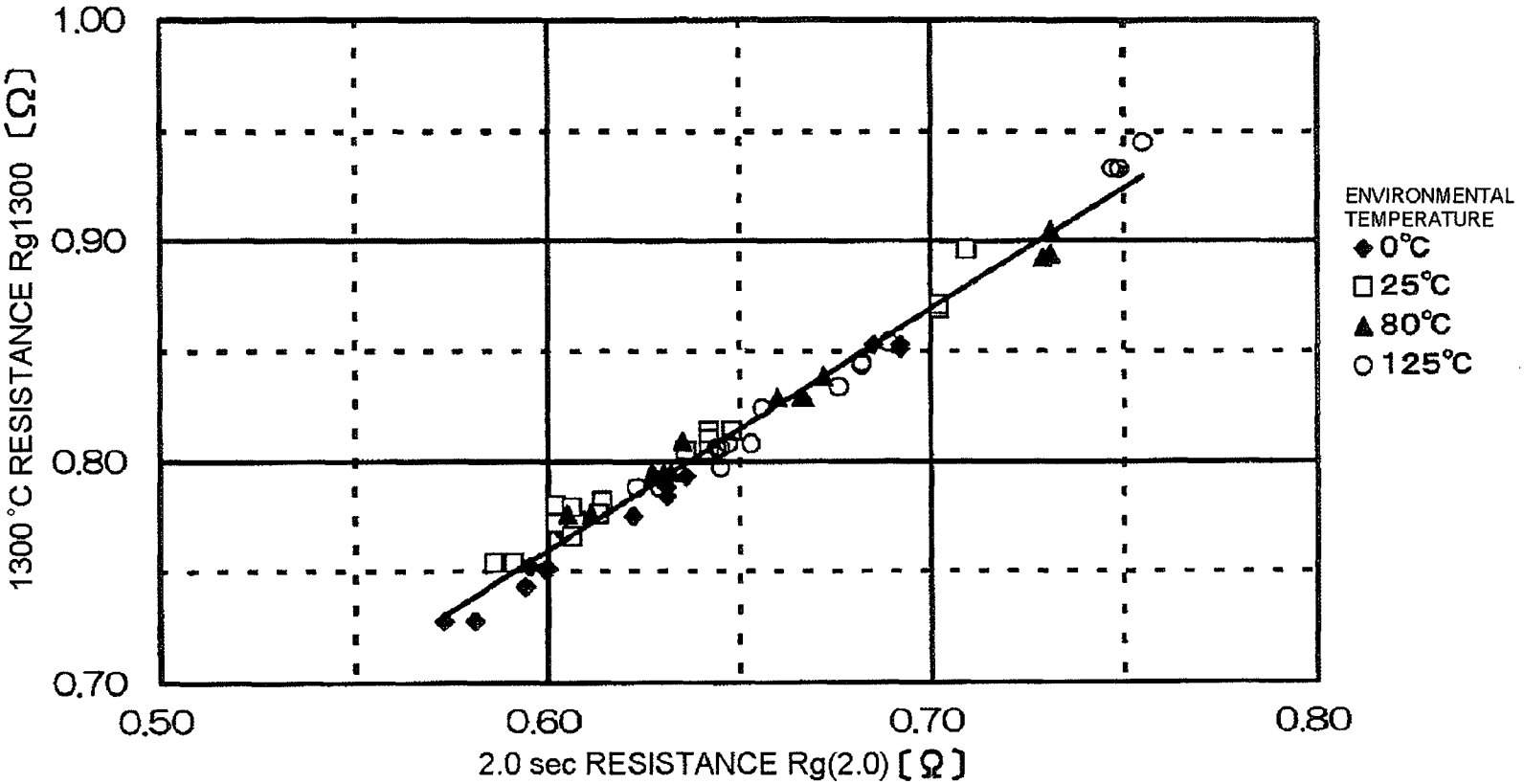
FIG. 12 is a graph showing the relation between the temperature-raising-period resistances Rg(2.0) at the elapsed time t=2.0 sec and the 1300° C. resistances of glow plugs used in Embodiment 1.
Figure 13:
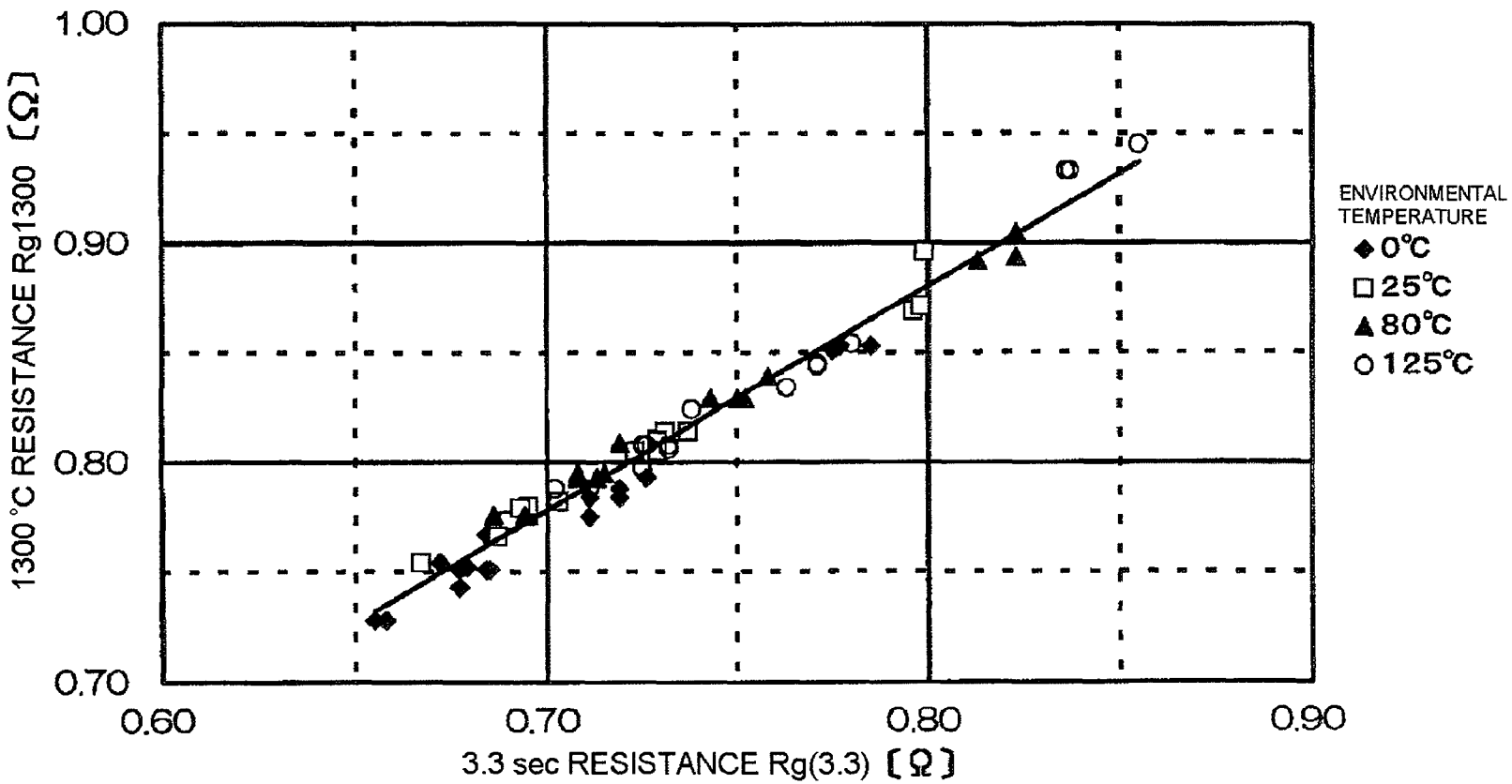
FIG. 13 is a graph showing the relation between the temperature-raising-period resistances Rg(3.3) at the elapsed time t=3.3 sec and the 1300° C. resistances of glow plugs used in Embodiment 1.

Further, each of FIGS. 10 to 13 shows the relation between the 1300° C. resistances Rg1300 and the temperature-raising-period resistances of the glow plugs at a predetermined timing in the temperature-raising period after start of supply of electricity (notably, cranking was not performed). Specifically, FIG. 10 shows the relation between the 1300° C. resistances Rg1300 and the temperature-raising-period resistances of the glow plugs measured when the elapsed time t was 0.5 sec (0.5 sec resistances Rg(0.5)); FIG. 11 shows the relation between the 1300° C. resistances Rg1300 and the temperature-raising-period resistances of the glow plugs measured when the elapsed time t was 1.0 sec (1.0 sec resistances Rg(1.0)); FIG. 12 shows the relation between the 1300° C. resistances Rg1300 and the temperature-raising-period resistances of the glow plugs measured when the elapsed time t was 2.0 sec (2.0 sec resistances Rg(2.0)); and FIG. 13 shows the relation between the 1300° C. resistances Rg1300 and the temperature-raising-period resistances of the glow plugs measured when the elapsed time t was 3.3 sec (3.3 sec resistances Rg(3.3)).

FIG. 9 reveals that the glow plugs (including the lead wires) show variations in resistance (in both pre-electrification resistance Rg(0) and 1300° C. resistance Rg1300) at each thermostatic chamber temperature (environmental temperature). However, there is a correlation between the pre-electrification resistance Rg(0) and the 1300° C. resistance Rg1300 such that a glow plug which is high in pre-electrification resistance Rg(0) is also high in the 1300° C. resistance Rg1300. Further, FIG. 9 reveals that when a relation (linear relation) between the pre-electrification resistance Rg(0) and the 1300° C. resistance Rg1300 at each of the different thermostatic chamber temperatures is represented by a straight line, the straight lines representing the relations at the different thermostatic chamber temperatures become parallel on the graph.

That is, the graph of FIG. 9 shows that the pre-electrification resistances Rg(0) of the glow plugs form four groups in accordance with the temperature of the thermostatic chamber (environmental temperature; i.e., environmental conditions such as ambient temperature, temperature of the engine block, temperature of engine cooling water, temperature of lubrication oil). It is understood from the above that, unless the temperature of the thermostatic chamber (or a value of an environmental condition corresponding thereto) is known, the 1300° C. resistances Rg1300 corresponding to the detected post-electrification resistances Rg(0) and used as the target resistances Rm1 to Rmn in the maintaining period, cannot be properly obtained.

Meanwhile, the graph of FIG. 10 shows that the glow plugs (including the lead wires) exhibit variations in resistance (in both 0.5 sec resistance Rg(0.5) and 1300° C. resistance Rg1300). However, there is a correlation between the 0.5 sec resistance Rg(0.5) and the 1300° C. resistance Rg1300 such that a glow plug which is high in the 0.5 sec resistance Rg(0.5) is also high in the 1300° C. resistance Rg1300.

In addition, unlike FIG. 9, the relation between the 0.5 sec resistance Rg(0.5) and the 1300° C. resistance Rg1300 can be represented by a common regression equation of a linear function (primary expression) (specifically, Equation (1): $Rg1300(\Omega)=1.40\times Rg(0.5)+0.180$) irrespective of the temperature of the thermostatic chamber.

Notably, the relation between the 1.0 sec resistance Rg(1.0) and the 1300° C. resistance Rg1300 shown in FIG. 11 can be represented by a common regression equation of a linear function (primary expression) (specifically, Equation (2): $Rg1300(\Omega)=1.27\times Rg(1.0)+0.120$).

Further, the relation between the 2.0 sec resistance Rg(2.0) and the 1300° C. resistance Rg1300 shown in FIG. 12 can be represented by a common regression equation of a linear function (primary expression) (specifically, Equation (3): $Rg1300(\Omega)=1.10\times Rg(2.0)+0.100$).

Moreover, the relation between the 3.3 sec resistance Rg(3.3) and the 1300° C. resistance Rg1300 shown in FIG. 13 can be represented by a common regression equation of a linear function (primary expression) (specifically, Equation (4): $Rg1300(\Omega)=1.02\times Rg(3.3)+0.060$).

According to the graph of FIG. 10 or the regression equation (1), even in the case where the temperature of the thermostatic chamber (or a value of an environmental condition corresponding thereto) is unknown, if the 0.5 sec resistances Rg(0.5) can be detected, the target resistances Rm1 to Rmn (the 1300° C. resistances Rg1300) corresponding to the 0.5 sec resistances Rg(0.5) and used to render the heat temperatures of the heat generation coils 21 of the glow plugs equal to the target temperature Tm (1300° C.) in the maintaining period after t=3.3 sec, can be properly determined.

Similarly, if the 1.0 sec resistance Rg(1.0) can be detected, from the graph of FIG. 11 or the regression equation (2), it is possible to properly determine the target resistances Rm1 to Rmn (the 1300° C. resistances Rg1300) corresponding to the 1.0 sec resistances Rg(1.0) and used to render the heat temperatures of the heat generation coils 21 equal to the target temperature Tm (1300° C.) in the maintaining period.

Similarly, if the 2.0 sec resistance Rg(2.0) can be detected, from the graph of FIG. 12 or the regression equation (3), it is possible to properly determine the target resistances Rm1 to Rmn (the 1300° C. resistances Rg1300) corresponding to the 2.0 sec resistances Rg(2.0) and used to render the heat temperatures of the heat generation coils 21 equal to the target temperature Tm (1300° C.) in the maintaining period.

Further, if the 3.3 sec resistance Rg(3.3) can be detected, from the graph of FIG. 13 or the regression equation (4), it is possible to properly determine the target resistances Rm1 to Rmn (the 1300° C. resistances Rg1300) corresponding to the 3.3 sec resistances Rg(3.3) and used to render the heat temperatures of the heat generation coils 21 equal to the target temperature Tm (1300° C.) in the maintaining period.

Moreover, as can be understood through mutual comparison among FIGS. 10 to 13, the greater the elapsed time t, the smaller the variation of data (the higher the correlation). That is, it is understood that the greater the elapsed time t after which the temperature-raising-period resistances are measured (the more delayed the timing of measurement of the temperature-raising-period resistance), the higher the accuracy of the 1300° C. resistances Rg1300 obtained from the graph, and the higher the accuracy of the determined target resistances Rm1 to Rmn.

Notably, in the above, the relation between the temperature-raising-period resistance and the maintaining resistance is shown for the case where the heater temperature (corresponding to the target temperature) is set to 1300° C. However, the same holds true for the case where the maintaining temperature is set to a different value (e.g., 1200° C., etc.).

Thus, once the temperature-raising-period resistances (0.5 sec resistances Rg(0.5), 1.0 sec resistances Rg(1.0), 2.0 sec resistances Rg(2.0), or 3.3 sec resistances Rg(3.3)) are known, the target resistances Rm1 to Rmn can be accurately set by use of FIGS. 10 to 13 or the regression equations (1) to (4) obtained therefrom, irrespective of variations in characteristics among the glow plugs GP1, etc.

Next, processing in the maintaining mode will be described with reference to FIG. 8. First, when the main control section 111 makes a "Yes" determination in step S12; i.e., when the elapsed time t is less than 30 sec, the main control section 111 proceeds to step S13 so as to correct the values of the target resistances Rm1 to Rmn, and then proceeds to step S14.

The reason why correction is performed will be described below. As described above, through supply of electricity, the temperature of the heat generation coil 21 is raised to a high temperature within a short period of time (e.g., about 3 sec). However, due to heat transferred from the generation coil 21, the temperatures of the lead wires HR1, etc. and the other resistor portions 5 (the electricity supply terminal rod 13, etc.) of the glow plug 1 (GP1, etc.) gradually increase over, for example, about 30 sec with a delay with respect to the temperature rise of the heat generation coil 21, even when a temperature change due to a change in the temperature WT of engine cooling water (described below) is not taken into consideration. As the temperatures of the lead wires HR1, etc. and the other resistor portions 5 rise, the resistances of the other resistor portions 5 and the lead wire HR1, etc. also increase.

Therefore, in the present embodiment, as will be described below, by means of resistance control for controlling the resistances Rg1(*t*), etc. of the glow plugs GP1, etc. such that the resistances Rg1(*t*) coincide with the target resistances Rm1, etc., the heater temperatures Tg1(*t*) to Tgn(t) of the heat generation coils 21 of the glow plugs GP1, etc. are maintained at the target temperature Tm.

Incidentally, in the present embodiment, as described above, the graphs shown in FIGS. 10 to 13 or the regression equations (1) to (4) obtained therefrom are used so as to acquire the target resistances Rm1, etc. in steps SA6 an SB4. When these graphs and regression equations are obtained, as described above, each sample glow plug is mounted to the engine head EH, and the glow plug and the engine head EH are placed in a thermostatic chamber. Electricity is then supplied to the glow plug so as to raise the heater temperature of the heat generation coil 21. After that, while maintaining the heater temperature at 1300° C., the 1300° C. resistance Rg1300 of the glow plug after elapse of a sufficient time is measured, and the target resistance Rm1 is obtained on the basis of the 1300° C. resistance Rg1300 by use of the regression equation (1), etc.

Accordingly, it is considered that a value which the resistance Rg of the glow plug must reach after heat is sufficiently transferred from the heat generation coil 21 to the other resistor portions 5 of the glow plug is given as the target resistance Rm1, etc.

In other words, in a short period of time immediately after the temperature rise (immediately after the start of the maintaining period), heat has not yet been sufficiently transferred from the heat generation coil 21 to the other resistor portions 5, and the resistances of the other resistor portions 5 are relatively small. Therefore, it is considered that a value smaller than the target resistance Rm1, etc. obtained from the regression equation (1), etc. must be used as the target value of the resistance Rg of the glow plug in this period.

Here, a case will be considered where, while the values obtained in the above-described step SA6 or SB4 are used as the target resistances Rm1 to Rmn of the glow plugs GP1, etc. as they are (i.e., without correction to be described below) immediately after the temperature rise, the resistance control is performed such that the resistances (maintaining-period resistances) Rg1(*t*) to Rgn(t) of the glow plugs 1 coincide with the target resistances Rm1, etc. In such a case, in a period at the beginning, the resistances of the heat generation coils 21 are controlled to be greater than proper values, due to the increases in the resistances of the other resistor portions 5 and the lead wires HR1, etc. from heat transfer being small in the period at the beginning. That is, the heater temperatures Tg1(*t*), etc. are controlled to a temperature higher than the target maintaining temperature (e.g., 1300° C.), which is contrary to the purpose of maintaining the heater temperatures Tg1(*t*), etc. constant.

Accordingly, correction (heat transfer correction) must be performed so as to gradually change the target resistances Rm1 to Rmn as the resistances of the other resistor portions 5 and the lead wires HR1, etc. gradually increase due to heat transfer.

As can be understood from the above description, the amount of correction by the heat transfer correction is such that the amount of correction is large at the beginning of the maintaining mode and is decreased gradually. Therefore, in the present embodiment, immediately after the start of the maintaining mode, correction is performed in such a manner that a relatively large correction value is subtracted from each target resistance. With elapse of time, the correction value which is subtracted from each target resistance is decreased. When the elapsed time t becomes equal to or greater than 30 sec, correction is not performed.

A specific method for the heat transfer correction in step S13 of the present embodiment will be described below. In this step S13, in the heat transfer correction at the beginning of the maintaining mode (e.g., t=3.3 sec), values obtained by subtracting 27 mΩ (correction value) from the already acquired target resistances Rm1 to Rmn are set as new target resistances (Rm1=Rm1−27 mΩ, . . . , Rmn=Rmn−27 mΩ). The magnitude of the correction value which is subtracted from the target resistances is decreased by 1 mΩ every time the elapsed time t increases by 1 sec, so that the correction value becomes zero when the elapsed time t reaches 30 sec (more accurately, 30.3 sec). Notably, when the elapsed time t exceeds 30 sec, this step S13 is not performed due to the determination in step S12.

In this manner, the target resistances Rm1, etc. are corrected in a short period of time (in the present embodiment, 30 sec) at the beginning of the maintaining mode period (immediately after the temperature rise). Thus, proper (corrected) target resistances Rm1, etc. can be obtained in consideration of the fact that the resistances Rg1(*t*), etc. of the glow plugs GP1, etc. remain low because heat has not been transferred from the heat generation coils 21 to the other resistor portions 5 of the glow plugs GP1, etc. Thus, even in this period, the heater temperatures Tg1(*t*), etc. of the heat generation coils 21 of the glow plugs GP1, etc. can be maintained at the target temperature (in the present example, 1300° C.).

Notably, in the present embodiment, the magnitude of the correction value at the beginning of the maintaining mode is set to 27 ΩQ, and is decreased such that the correction value becomes 0 when the elapsed time t becomes equal to or greater than 30 sec. These values are determined as follows. The temperature of the heat generation coil 21 of the glow plug GP1, etc. is raised to a predetermined temperature (e.g., 1300° C.), and maintained at the predetermined temperature. Within a sufficiently long period of time immediately after the temperature rise, the magnitude of an increase in the overall resistance of the glow plug GP1, etc., including the lead wire HR1, etc., and a period in which the overall resistance continuously increases are determined, and the magnitude of the correction value and the correction period are determined on the basis of these data.

Meanwhile, when a "No" determination is made in step S12 (that is, when the elapsed time t is equal to or greater than 30 sec), the main control section 111 proceeds to step S14, while skipping step S13, because of the following reason. When the elapsed time t becomes equal to or greater than 30 sec, increases in the resistances of the other resistor portions 5 and the lead wire HR1, etc. due to heat transferred from the heat generation coil 21 substantially become zero, and therefore, the above-described heat transfer correction becomes unnecessary.

Subsequently, in step S14, the main control section 111 receives the output of the water temperature sensor 312 via the interface circuit 108 so as to acquire the temperature WT of engine cooling water (second water temperature WT2).

In step S16, the main control section 111 corrects (water temperature correction) the values of the target resistances Rm1 to Rmn at each point in time by use of the second water temperature WT2 and the previously acquired first water temperature WT1 (see steps SA2 and SB1). The main control section 111 then proceeds to step S17.

The need for this water temperature correction will be described below. As described above, when a short period of time has elapsed after the startup of the engine, the environmental conditions around the glow plugs GP1, etc. change; for example, the temperature of engine cooling water and the temperature of the engine block rise. As a result, due to causes other than the heat transferred from the heaters 2, the resistances of the lead wires HR1, etc. and the other resistor portions 5 (the electricity supply terminal rod 13, the metallic shell 3, etc.) of the glow plugs GP1, etc. increase gradually. Thus, in order to maintain the heater temperatures Tg1(*t*) of the glow plugs GP1, etc. at the target temperature Tm (e.g., 1300° C.), the target resistances Rm1 to Rmn must be changed gradually in accordance with increases in the overall resistances (the maintaining-period resistances) Rg1(*t*) to Rgn(t) of the glow plugs GP1, etc., including the lead wires HR1, etc., due to such causes. Therefore, in the present embodiment, the target resistances Rm1 to Rmn are corrected based on the temperature WT of engine cooling water (the first water temperature WT1 and the second water temperature WT2) among other environmental conditions. The temperature WT of engine cooling water can be readily measured, and the degree of influence of the temperature WT on the resistances of the glow plugs GP1, etc. can be readily studied.

Specifically, the main control section 111 corrects the target resistance Rm1 in accordance with an equation Rm1=Rm1+Cb (WT2−WT1) by use of the first water temperature WT1 [° C.], which is obtained at the same timing (e.g., t=0.5 sec) as the timing at which the target resistance Rm1 is acquired, the second water temperature WT2 [° C.], and a water temperature correction coefficient Cb [mΩ/deg], to thereby acquire a corrected new target resistance Rm1. The remaining target resistances Rm2 to Rmn are also corrected in accordance with similar equations (Rm2*b*=Rm2+Cb (WT2−WT1), . . . , Rmnb=Rmn+Cb (WT2−WT1)). Thus, a series of corrected new target resistances Rm1 to Rmn are acquired. This equation can be applied to a case where the second water temperature WT2 becomes lower than the first water temperature WT1 (for example, the engine is stopped in a state where due to high speed operation the water temperature WT becomes higher than that in an ordinary operation state, and electricity is again supplied to the glow plug immediately after the stoppage so as to start the engine).

Notably, the water temperature correction coefficient Cb is a coefficient which shows the degree of influence of a change in the temperature WT of engine cooling water on the resistances Rm1, etc. of the glow plugs GP1, etc. in a state where the temperatures of the glow plugs GP1, etc. are maintained at a high temperature (e.g., 1300° C.). This coefficient provides an amount by which the target resistances Rm1, etc. are changed when the water temperature WT increases by 1 degree.

Preferably, this water temperature correction coefficient Cb is obtained as follows. First, a sample glow plug 1 having a given part number is prepared. A thermocouple is bonded to a distal end portion of the sheathed heater 2 so as to measure the heater temperature of the heat generation coil 21. Electricity is supplied to the glow plug 1 by use of a lead wire HR equivalent to the lead wire HR1, etc., and the supply of electricity is controlled such that the heater temperature is maintained at a fixed temperature (e.g., 1300° C.). At the beginning, this engine is brought into a state where the temperature WT of engine cooling water is sufficiently low (e.g., 0° C.). The heater temperature T1 of the heat generation coil 21 is raised to a predetermined temperature (e.g., 1300° C.) within a short period of time (e.g., about 3 sec), by supplying electricity to the glow plug 1, so as to start the engine. While the rotational speed of the engine is maintained at a predetermined rotational speed, temperature control is performed by use of the output of the thermocouple such that the temperature of the heat generation coil 21 of the glow plug 1 is maintained at a fixed temperature (e.g., 1300° C.). That is, electrification control is performed such that the output of the thermocouple becomes constant.

Although the temperature WT of the engine cooling water hardly changes in a period at the beginning (in a period in which the temperature of the glow plug is raised and the engine is started), the temperature WT gradually increases over a long period of a few minutes to a few tens of minutes, and is then maintained at an approximately fixed temperature.

Meanwhile, since the temperature of the heat generation coil 21 of the glow plug 1 is controlled to a fixed temperature as described above, the resistance R1 of the glow plug 1 increases gently immediately after the completion of temperature rise (immediately after the start of temperature maintaining), and becomes substantially constant. As a result of the water temperature WT rising, the resistances of the lead wire HR and the other resistor portions 5 of the glow plug 1 increase gradually. Meanwhile, since the temperature of the heat generation coil 21 is controlled to be maintained at a fixed temperature, the resistance of the heat generation coil 21 is maintained at a substantially fixed value. Therefore, the overall resistance R1 of the glow plug 1 increases.

From the results of the above-described test, the degree of influence of a change in the water temperature WT on the resistance RI of the glow plug 1 is found. That is, the amount of an increase in the resistance RI of the glow plug 1 caused by a 1 degree increase in the water temperature WT is found. In the present embodiment, it was found that the coefficient is −0.7 [deg/deg]; i.e., a 1 degree increase in the water temperature WT results in a 0.7 degree decrease in the heater temperature T1.

Separately, the degree of influence of a change in the heater temperature T1 on the resistance R1 of the glow plug 1 in a state where the heat generation coil 21 is maintained at a high temperature is investigated so as to determine a resistance change rate [mΩ/deg], which shows the amount of change in the resistance R1 of the glow plug 1 caused by a 1 degree change in the heater temperature T1. Specifically, the glow plug 1, to which the above-mentioned thermocouple is bonded, is attached to an aluminum block (simulating an engine head) placed within a thermostatic chamber whose inside temperature is 25° C. at that point in time. Electricity is supplied to the glow plug 1 in this state such that the temperature of the glow plug 1 is maintained at 1100° C. The resistance of the glow plug 1 at 1100° C. is measured. Subsequently, electricity is supplied to the glow plug 1 such that the temperature of the glow plug 1 is maintained at 1200° C. The resistance of the glow plug 1 at 1200° C. is measured. In the case of the glow plug 1 of the present embodiment, its resistance was 700 mΩ at 1100° C. and 750 mΩ at 1200° C. From this result, it is found that, in the present embodiment, a 1 degree increase in the heater temperature T1 causes a 0.5 mΩ increase in the resistance RI of the glow plug 1 (0.5 mΩ/deg).

From this, the water temperature correction coefficient Cb is determined to be 0.35(=−0.5×−0.7) [mΩ/deg], and equations used for the above-described correction in the present embodiment are determined to be Rm1=Rm1+0.35(WT2−WT1), etc.

In step S17, as in the above-described step S3, at a timing when the switching elements 1051 to 105n are on, the main control section 111 fetches, as voltage signals V1(*t*) to Vn(t), the voltages Vg1(*t*) to Vgn(t) applied to the glow plugs GP1, etc., and also fetches, as current signals I1(*t*) to In(t), currents Ig1(*t*) to Ign(t) flowing through the glow plugs GP1, etc.

In step S18, as in the above-described step S4, the main control section 111 calculates the resistances (temperature-raising-period resistances) Rg1(*t*) to Rgn(t) of the glow plugs GP1, etc. at the elapsed time t from the start of electrification (Rg1(*t*)=Vg1(*t*)/Ig1(*t*), . . . , Rgn(t)=Vgn(t)/Ign(t)).

Further, in step S19, the main control section 111 performs a PWM-scheme electrification control such that the acquired resistances (maintaining resistances) Rg1(*t*) to Rgn(t) of the glow plugs GP1, etc. coincide with the target resistances Rm1 to Rmn. Specifically, the glow plugs GP1, etc. are pulse-driven by means of switching the switching elements 1051 to 105n. The duty ratio at that time is changed in accordance with an error of the maintaining resistance from the target resistance by means of, for example, PI control. Thus, the heater temperatures Tg1(*t*) to Tgn(t) of the heat generation coils 21 of the glow plugs GP1, etc. can be maintained at the target temperature Tm (e.g., 1300° C.).

After that, the main control section 111 determines in step S20 whether or not the maintaining mode has ended (e.g., whether or not the elapsed time t has reached 180 sec). When the maintaining mode has not yet ended (No), the main control section 111 returns to step S12, and repeats the processing similar to the above-described processing. Meanwhile, when maintaining mode has ended (Yes), the main control section 111 ends the electrification processing for the glow plugs GP1, etc.

Further, the glow plug electrification control system 100 (the glow plug electrification control apparatus 101) of the present embodiment can raise the heater temperatures Tg1(*t*) to Tgn(t) of all the glow plugs GP1 to GPn to the predetermined raised temperature (e.g., 1300° C.) at the end time $t_{end}$ (e.g., t=3.3 sec).

In general, even when the plurality of glow plugs 1 are of the same part number, they have variations in characteristics, and their resistances differ from one another. Here, for the glow plug electrification control system 100, there will be considered a case where the glow plug GP1 connected to the glow plug electrification control apparatus 101 is replaced with a glow plug GP1*e* having a different resistance.

The original glow plug GP1 has been described above. That is, at each elapsed time t, electric power whose magnitude P(t) is equal to the reference power magnitude Pb(t) that changes to follow the curve shown in FIG. 4, is supplied to the glow plug GP1. Therefore, when the elapsed time t reaches the end time $t_{end}$, the temperature of the glow plug GP1 (the heat generation coil 21) reaches the predetermined temperature (e.g., 1300° C.).

When a change in the temperature of the glow plug GP1 and a change in the temperature of the glow plug GP1*e* during the temperature rise are compared, it is found that, at each elapsed time t, electric power whose magnitude P(t) is equal to the reference power magnitude Pb(t) is supplied to both the glow plug GP1 and the glow plug GP1*e*. That is, conceivably, at each elapsed time t from the start of electrification, the same electric power is supplied to the glow plug GP1 and the glow plug GP1*e*, and, at each elapsed time t, the respective heat generation coils 21 generate heat of the same quantity corresponding to the same energy. In addition, since the glow plug GP1 and the glow plug GP1*e* are attached to the same portion of the engine EG through replacement, the glow plug GP1 and the glow plug GP1*e* are substantially the same in terms of heat dissipation. Accordingly, under the same environmental temperature condition (i.e., the same ambient temperature and the same engine cooling water temperature), despite that the glow plug GP1 and the glow plug GP1*e* have different resistances, the glow plug GP1 and the glow plug GP1*e* have substantially the same temperature at each elapsed time t, and their temperatures can be raised to the same temperature (e.g., 1300° C.) to follow the same temperature curve.

Moreover, in the present embodiment, the temperature-raising-period resistances Rg1(*t*), etc. of the glow plugs GP1 and GP1*e* at predetermined timings (t=0.5, 1.0, 2.0, 3.3 sec) during the temperature-raising period are acquired. Accordingly, through measurement of the resistances of the glow plugs GP1 and GP1*e* at these timings, the temperature-raising-period resistances Rg1(*t*), etc. of the two glow plugs GP1 and GP1*e* can be acquired for the case where their heater temperatures are the same (e.g., 300° C., 600° C., etc.).

In addition, since the temperature-raising-period resistances Rg1(*t*), etc. are values which reflect variations in characteristics of the glow plugs GP1 and GP1*e*, target resistances which fit the characteristics of the glow plugs GP1 and GP1*e* can be set by means of obtaining the target resistance Rm1 on the basis of the values and by use of the graphs of FIGS. 10, 11, 12, and 13 or the regression equations (1), etc.

Notably, in the present embodiment, the switching elements 1051 to 105n and operations of steps S3, S4, S5 to S7 in the main control section 111 correspond to the temperature-raising-period electrification control means and the supply power control means. Of these steps, steps S3 to S5 correspond to the reference power magnitude provision means. Further, step S3, S4, S6, and S7 correspond to the power magnitude control means. Of these steps, steps S3 and S4 correspond to the parameter (voltage-etc.) acquisition means, step S4 corresponds to the temperature-raising-period-resistance acquisition means, step S6 corresponds to the duty ratio acquisition means, and step S7 corresponds to the pulse electrification means, respectively.

Further, the switching elements 1051 to 105n and operations of steps SA1 to SA4, SA6, SB2, SB4, S12 to S20 in the main control section 111 correspond to the maintaining-period electrification control means. Of these steps, steps S18 corresponds to the maintaining-period-resistance acquisition means, steps SA6 and SB4 correspond to the target resistance acquisition means, step S19 corresponds to the maintaining-period-resistance control means. Further, steps SA4 and SB2 correspond to the first environmental value acquisition means and the first water temperature acquisition means, and step S14 corresponds to the second environmental value acquisition means and the second water temperature acquisition means. Further, step S13 corresponds to the heat transfer correction means, and step S16 corresponds to the environment correction means and the water temperature correction means. Steps SA3 and SB1 correspond to the cranking detection means.

Embodiment 2

Figure 14:
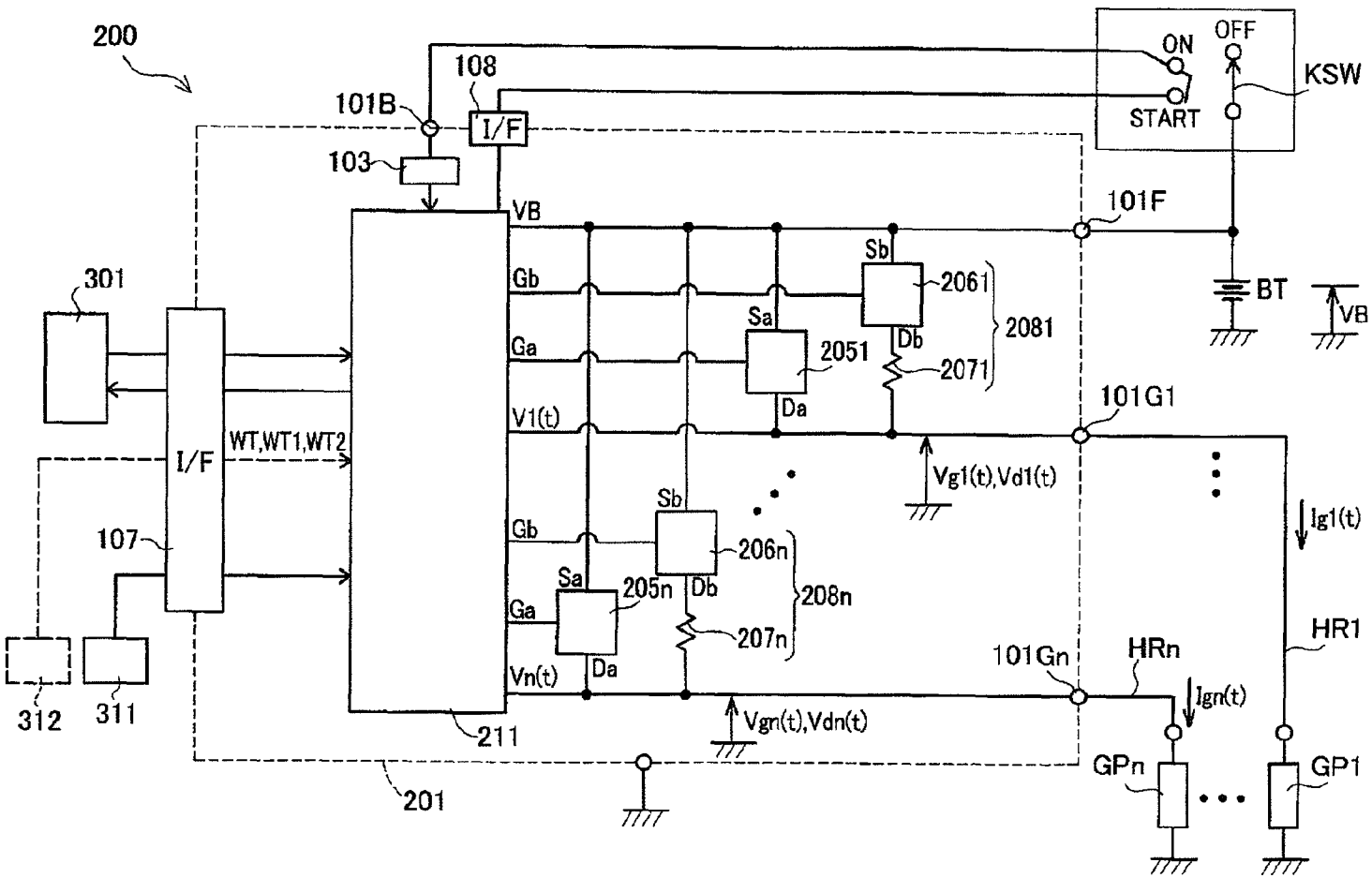
FIG. 14 is a circuit diagram showing a glow plug electrification control system and a glow plug electrification control apparatus according to Embodiment 2.

Next, a second embodiment will be described with reference to FIGS. 14 and 15. In the Embodiment 1, an FET having a current detection function is used for the switching elements 1051, etc. In contrast, in a glow plug electrification control system 200 and a glow plug electrification control apparatus 201 according to the present Embodiment 2, an FET which does not have a current detection function is used for the switching elements 2051 to 205n so as to start and stop supply of electric current to the glow plugs GP1 to GPn. Further, since the FET does not have a current detection function, resistance division circuits 2081 to 208n are separately provided so as to detect the resistances Rg1(*t*), etc. of the glow plugs GP1, etc. Further, a step is provided in the processing flow so as to detect the resistances Rg1(*t*), etc. of the glow plugs GP1, etc. by use of the resistance division circuits 2081, etc. These different portions will be mainly described, and other similar portions will not be described or will be described briefly.

Since the glow plugs GP1, etc. used in the present Embodiment 2 are identical with those used in Embodiment 1, their description will not repeated.

Next, the glow plug electrification control system 200 and the glow plug electrification control apparatus 201 of the present Embodiment 2 will be described. FIG. 14 is a block diagram showing the electrical configuration of the glow plug electrification control system 200 and the glow plug electrification control apparatus 201 of the present Embodiment 2.

The glow plug electrification control system 200 includes not only the glow plug electrification control apparatus 201 but also glow plugs GP1 to GPn, a battery BT, and a key switch KSW, which are similar to those employed in Embodiment 1. Further, the glow plug electrification control system 200 is connected to an ECU 301 and an alternator 311 via an interface circuit 107.

A main control section 211 of the glow plug electrification control apparatus 201 receives via a power supply circuit 103 a stable operation voltage for signal processing. When the key switch KSW is turned to the ON position or the start position, the main control section 211 operates. Meanwhile, when the key switch KSW is turned to the OFF position, the main control section 211 stops the operation. Notably, as in the case of the Embodiment 1, when the key switch KSW is turned to the start position, a signal indicating that the key switch KSW has been turned to the start position is supplied to the main control section 211 via the interface circuit 108, whereby the main control section 211 can detect the engine cranking.

Further, electric power is supplied from the battery BT to n switching elements 2051 to 205n via a battery connection terminal 101F. In the present Embodiment 2, unlike Embodiment 1, an ordinary MOSFET which does not have a current detection function is used for the switching elements 2051 to 205n. The voltage VB of the battery BT is supplied to respective source terminals Sa of the switching elements 2051 to 205n. Meanwhile, respective drain terminals Da of the elements 2051 to 205n are connected to a plurality of (n) glow plugs GP1 to GPn via corresponding glow connection terminals 101G1 to 101Gn, as in the case of Embodiment 1. Switching signals are supplied from the main control section 211 to respective gate terminals Ga of the elements 2051 to 205n. The elements 2051 to 205n turn ON and OFF in accordance with the voltage levels (high/low) of the switching signals so as to switch (ON/OFF) the supply of electricity to the glow plugs GP1 to GPn.

Further, as in the case of Embodiment 1, voltage signals V1(*t*) to Vn(t) are supplied to the main control section 211. The voltage signals V1(*t*) to Vn(t) represent voltages Vg1(*t*) to Vgn(t) applied to the glow plugs GP1 to GPn and the lead wires HR1 to HRn at timings when the switching elements 2051 to 205n are on.

Moreover, the glow plug electrification control apparatus 201 includes resistance division circuits 2081 to 208n in parallel with the switching elements 2051 to 205n. The resistance division circuits 2081 to 208n are composed of FETs 2061 to 206n, which are supplementary switching elements, and reference resistors 2071 to 207n (resistance Rref=1.0Ω) connected in series with the FETs.

The resistance division circuits 2081 to 208n are used as follows. That is, the FETs 2061 to 206n are usually off. However, these FETs 2061 to 206n (with source terminals Sb and drain terminals Db) are turned on by means of signals from corresponding gate terminals Gb at timings when the corresponding switching elements 2051 to 205n are off. As a result, a voltage is applied to the glow plugs GP1 to GPn via the corresponding FETs 2061 to 206n and the corresponding reference resistors 2071 to 207n. At that time, divided voltages Vd1(*t*) to Vdn(t) are generated across the glow plugs GP1 to GPn, respectively. The divided voltages Vd1(*t*) to Vdn(t) assume respective values obtained by dividing (resistance division) the battery voltage VB (accurately, a voltage obtained by subtracting an ON voltage of the FETs 2061, etc. from the battery voltage VB) by the reference resistors 2071 to 207n and the glow plugs GP1 to GPn and the lead wires HR1 to HRn.

Since the resistance Ref of the reference resistors 2071 to 207n is known (e.g., Rref=1.0Ω), by means of separately inputting the battery voltage VB to the main control section 211, the resistances Rg1(*t*) to Rgn(t) of the glow plugs GP1 to GPn and the lead wires HR1 to HRn can be detected.

In this manner, the resistances Rg1(*t*) to Rgn(t) of the glow plugs GP1 to GPn and the lead wires HR1 to HRn can be detected without use of relatively expensive FETs which are used in Embodiment 1 and have a current detection function.

Figure 15:
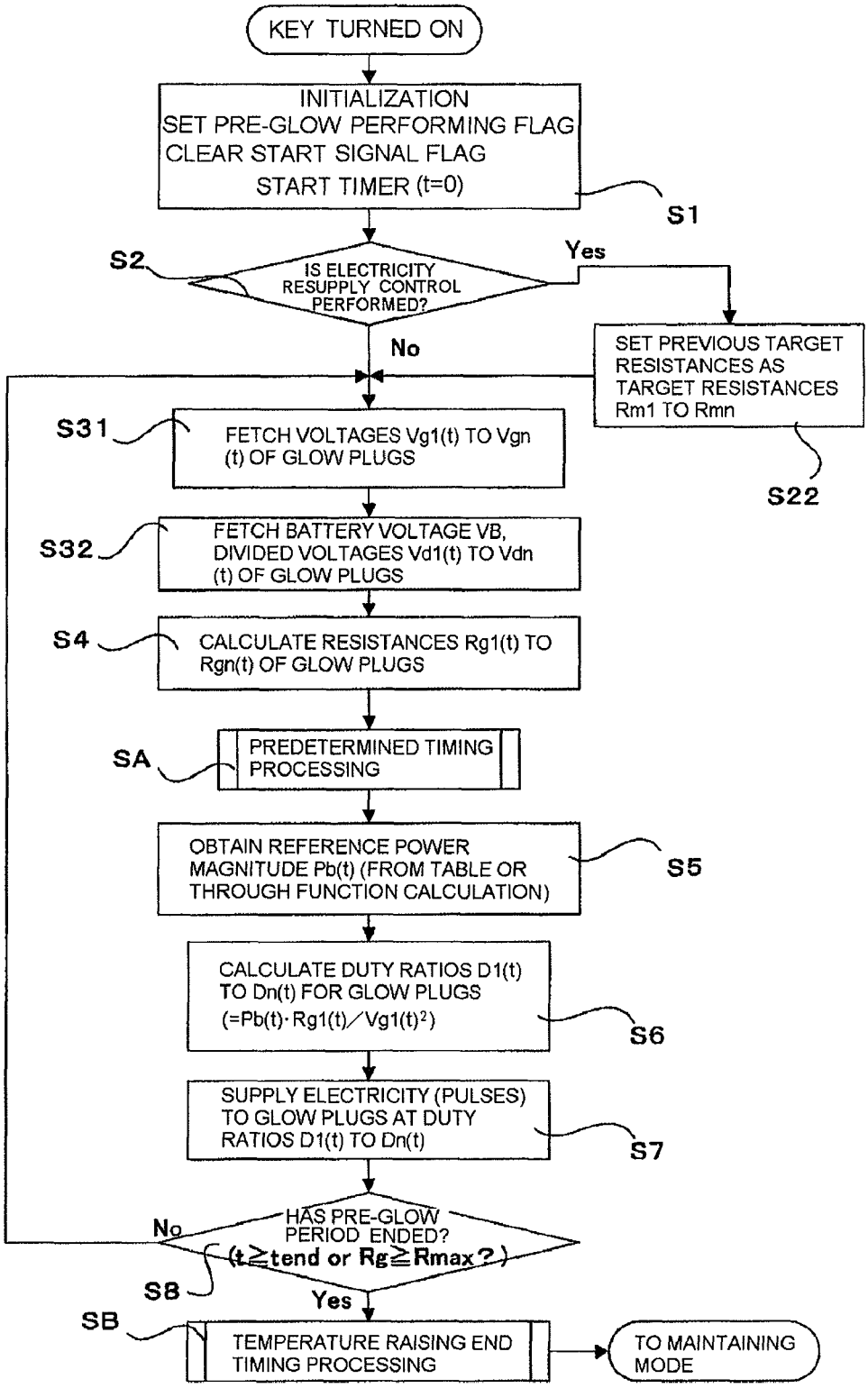
FIG. 15 is a flowchart showing electrification control performed by the glow plug electrification control apparatus according to Embodiment 2.

Specifically, as shown in FIG. 15, after determining in step S2 whether or not electricity resupply protection is performed, the main control section 211 performs the following processing in place of step S3 in Embodiment 1. That is, in step S31, the main control section 211 fetches, as voltage signals V1(*t*) to Vn(t), voltages Vg1(*t*) to Vgn(t) applied to the glow plugs GP1, etc. and the lead wires HR1, etc. at timings when the switching elements 2051 to 205n are on (the FETs 2061 to 206n are off).

Further, in step S32, the main control section 211 fetches divided voltages Vd1(*t*) to Vdn(t) applied to the glow plugs GP1, etc. and the lead wires HR1, etc. at timings when the switching elements 2051 to 205n are off and the FETs 2061 to 206n are on. Also, the main control section 211 fetches the battery voltage VB.

Subsequently, as in the case of Embodiment 1, in step S4, the main control section 111 calculates the resistances Rg1(*t*) to Rgn(t) of the glow plugs GP1, etc. and the lead wires HR1, etc. at the instant time (at the elapsed time t from the start of electrification). However, unlike Embodiment 1, the respective resistances are obtained by use of equations Rg1(*t*)= Rref−Vd1(*t*)/(VB−Vd1(*t*)), . . , Rref·Vdn(t)/(VB−Vdn(t)).

Since the remaining steps are identical with those in Embodiment 1, their description will not be repeated.

Thus, in the glow plug electrification control system 200 and the glow plug electrification control apparatus 201 of the present Embodiment 2 as well, the temperatures of the heat generation coils 21 of all the glow plugs GP1 to GPn can be increased to the predetermined temperature (e.g., 1300° C.) at the end time $t_{end}$.

Further, even when the glow plug GP1 is replaced with the glow plug GP1*e*, as in the case of Embodiment 1, the temperature of the glow plug GP1*e* reaches the predetermined temperature (e.g., 1300° C.) when the elapsed time t reaches the end time $t_{end}$.

Moreover, when a change in the temperature of the glow plug GP1 and a change in the temperature of the glow plug GP1*e* during the temperature rise are compared, it is found that, despite having different resistances, the glow plug GP1 and the glow plug GP1*e* have substantially the same temperature at each elapsed time t, and their temperatures can be raised to the same temperature (e.g., 1300° C.) to follow the same temperature curve.

Accordingly, as in Embodiment 1, the temperature-raising-period resistances of the glow plugs at predetermined timings (the elapsed time t=0.5, 1.0, 2.0, 3.3) during the temperature-raising period (0.5 sec resistance Rg(0.5), 1.0 sec resistance Rg(1.0), 2.0 sec resistance Rg(2.0), or 3.3 sec resistance Rg(3.3)) can be acquired properly. Further, the target resistances Rm1, etc. can be acquired from these data by use of the graphs of FIGS. 10 to 13 (or the regression equations (1) to (4)). Therefore, even when the resistances of the glow plugs GP1, etc. exhibit variations, the heater temperatures of the glow plugs GP1, etc. during the maintaining period can be maintained at the target temperature.

Notably, in the present Embodiment 2, the switching elements 2051 to 205n and operations of steps S31, S32, S4, S5 to S7 in the main control section 211 correspond to the temperature-raising-period electrification control means and the supply power control means. Of these steps, steps S31 and S32 to S5 correspond to the reference power magnitude provision means. Further, step S31, S32, S4, S6, and S7 correspond to the power magnitude control means. Of these steps, steps S31, S32, and S4 correspond to the parameter (voltage-etc.) acquisition means.

Modification 1

For example, in the glow plug electrification control apparatuses 101 and 201 (the glow plug electrification control systems 100 and 200) of Embodiments 1 and 2, in addition to the applied voltages Vg1(*t*), etc., the currents Ig1(*t*), etc., or the resistances Rg1(*t*), etc., the reference power magnitude Pb(t) acquired in step S5 is used so as to obtain the duty ratios D1(*t*), etc. in the temperature-raising period.

Figure 16:
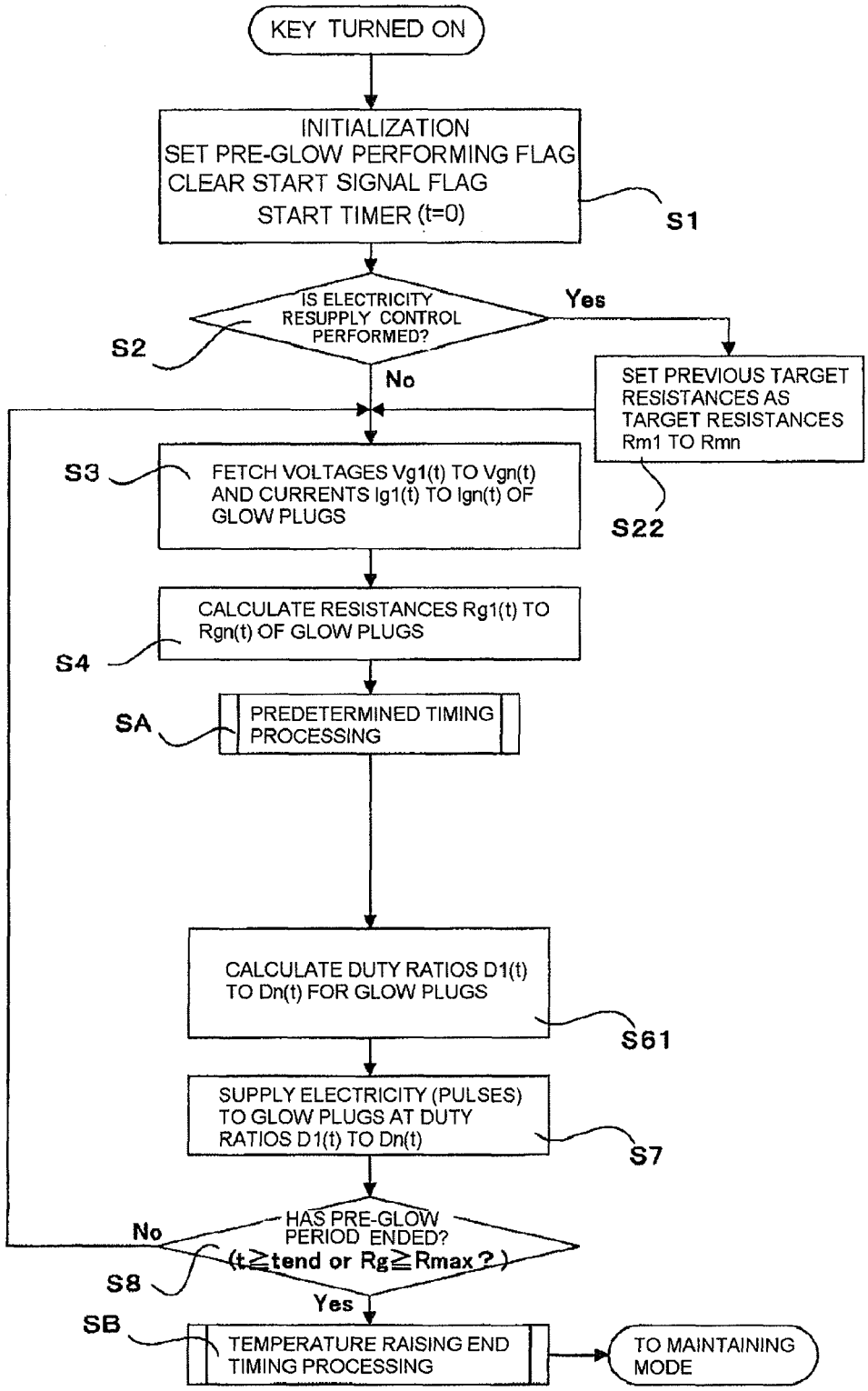
FIG. 16 is a flowchart showing electrification control performed by the glow plug electrification control apparatus according to Modification 1.

A glow plug electrification control apparatus 301 (a glow plug electrification control system 300) of the present Modification 1 differs from Embodiment 1 only in the method of obtaining the duty ratios D1(*t*) to Dn(t). Only this difference will be described with reference to FIG. 16.

As described above, the reference power magnitude Pb(t) used in Embodiments 1 and 2 can be obtained from the elapsed time t, calculated in consideration of engine water temperature or the like as well as the elapsed time t, or obtained from a table previously prepared through calculation. Accordingly, the duty ratios D1(*t*) to Dn(t) can be obtained without obtaining the reference power magnitude Pb(t).

That is, in the present Modification 1, without obtaining the reference power magnitude Pb(t) in step S5, the duty ratios D1(*t*), etc. are obtained. That is, step S5 in Embodiments 1 and 2 is eliminated, and step S61, which corresponds to step S6, is provided so as to obtain the duty ratios D1(*t*), etc. from the elapsed time t and the applied voltages Vg1(*t*), etc., the currents Ig1(*t*), etc., or the resistances Rg1(*t*), etc., through calculation or by making use of a previously prepared table.

In the present Modification 1, the switching elements 1051 to 105n and operations of steps S3, S4, S61, and S7 in the main control section 111 correspond to the temperature-raising-period electrification control means and the supply power control means. Of these steps, steps S3 and S4 correspond to the parameter (voltage-etc.) acquisition means, step S61 corresponds to the duty ratio acquisition means, and step S7 correspond to the pulse electrification means.

The present invention has been described with reference to Embodiments 1 and 2, and Modification 1. However, needless to say, the present invention is not limited to Embodiments 1 and 2, etc., and can be appropriately modified for application without departing from the scope of the invention.

For example, in Embodiment 1 and Modification 1, in step S4, the resistances Rg1(*t*) to Rgn(t) of the glow plugs are obtained from the applied voltages Vg1(*t*), etc. and the currents Ig1(*t*), etc.

However, the duty ratios D1(*t*) to Dn(t) can be obtained without use of the step for obtaining the resistances Rg1(*t*), etc., That is, the duty ratios D1(*t*), etc. may be calculated by use of the applied voltages Vg1(*t*), etc. and the currents Ig1(*t*), etc.

Further, in Embodiment 1, etc., when the key switch KSW is turned on, the glow plug electrification control system 100 (the glow plug electrification control apparatus 101) starts and supply of electric current to the glow plugs GP1, etc. is started. However, Embodiment 1, etc. may be modified such that supply of electric current to the glow plugs GP1, etc. is started when an instruction is issued from the engine control unit 301 via the interface circuit 107 after the operator turns the key switch KSW on and the glow plug electrification control apparatus 101 starts up.

Figure 6:
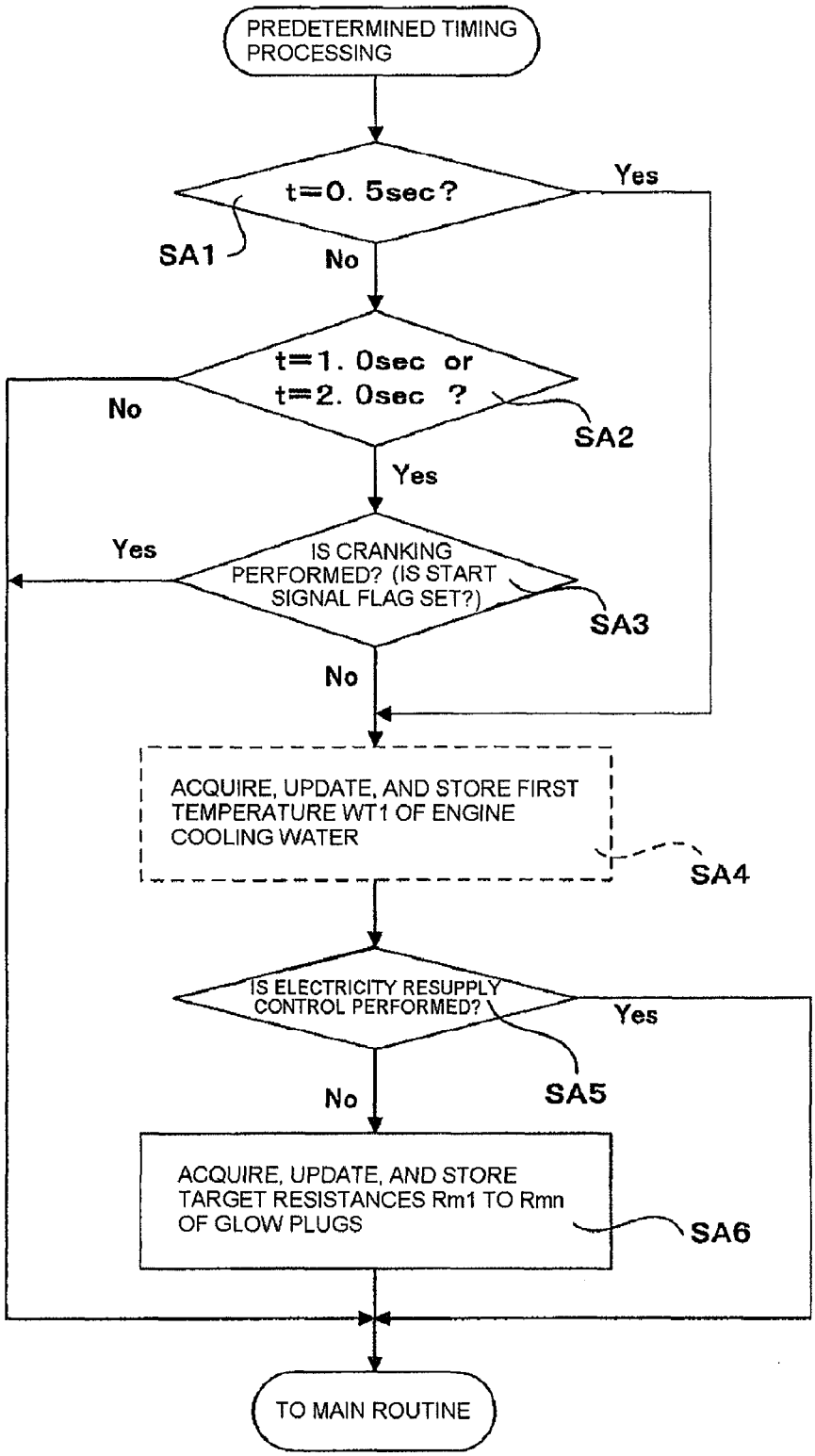
FIG. 6 is a flowchart showing the details of a subroutine for predetermined timing processing, in electrification control of Embodiment 1.

In the above-described Embodiments 1 and 2 and Modification 1, in consideration of rising of the resistances Rg1(*t*), etc. of the glow plugs GP1, etc. with rising of the water temperature, as indicated by broken lines in FIGS. 6, 7, and 8, the temperature WT of engine cooling water (the first water temperature WT1 and the second water temperature WT2) is measured, and the target resistances Rm1 to Rmn are corrected (see step SA4, SB2, S14, S16). However, in the case where the rising of the resistances Rg1(*t*), etc. of the glow plugs GP1, etc. with rising of the water temperature is considered to be small, measurement of the temperature of engine cooling water and correction on the basis thereof may be omitted in order to simplify the processing.

Further, the routine shown in FIG. 8 may be modified in such a manner that the main control section proceeds from step S13 directly to step S17 and that, when the elapsed time t is less than 30 sec (t<30 sec), the main control section performs correction for heat transfer in step S13, and when the elapsed time t is equal to or greater than 30 sec (t≧30 sec), the main control section performs correction for water temperature in steps S14 and S16, in place of the correction for heat transfer in step S13.

It should further be apparent to those skilled in the art that various changes in form and detail of the invention as shown and described above may be made. It is intended that such changes be included within the spirit and scope of the claims appended hereto.

This application is based on Japanese Patent Application No. JP 2008-14259 filed May 30, 2008, incorporated herein by reference in its entirety.

What is claimed is:

1. A glow plug electrification control apparatus which controls supply of electric current, via a lead wire, to a glow plug which includes a heat generation section generating heat in response to the current and which has a resistance having a positive correlation with a heater temperature of the heat generation section, the control apparatus comprising:

temperature-raising-period electrification control means for raising the heater temperature of the glow plug;

maintaining-period electrification control means for maintaining the heater temperature at a predetermined target temperature after the heater temperature has been raised;

temperature-raising-period-resistance acquisition means for acquiring, as a temperature-raising-period resistance, a resistance of the glow plug that includes a resistance of the lead wire and that is measured at a predetermined timing in a temperature-raising period in which the temperature-raising-period electrification control means raises the heater temperature; and maintaining-period resistance acquisition means for acquiring, as a maintaining-period resistance, the resistance of the glow plug including the resistance of the lead wire and that is measured in a maintaining period in which the maintaining-period electrification control means maintains the heater temperature, wherein the maintaining-period electrification control means comprises:

target resistance acquisition means for acquiring a target resistance corresponding to the target temperature on the basis of the temperature-raising-period resistance; and maintaining-period resistance control means for controlling the supply of the electric current to the glow plug such that the maintaining-period resistance coincides with the target resistance.

2. The glow plug electrification control apparatus according to claim 1, further comprising cranking detection means for detecting cranking of an engine, wherein the temperature-raising-period-resistance acquisition means acquires the temperature-raising-period resistance every time each of a plurality of predetermined timings falls within the temperature-raising period, at least until the cranking detection means the detects cranking; and the maintaining-period electrification control means acquires the target resistance on the basis of a latest temperature-raising-period resistance among temperature-raising-period resistances at the predetermined timings which were obtained before the cranking detection means detected the cranking.

3. The glow plug electrification control apparatus according to claim 2, wherein when the cranking detection means detects cranking before a first one of the predetermined timings falls within the temperature-raising period, the temperature-raising-period-resistance acquisition means acquires the temperature-raising-period resistance at the first predetermined timing; and when the temperature-raising-period resistance was not detected before detection of the cranking, the maintaining-period electrification control means acquires the target resistance on the basis of the temperature-raising-period resistance detected at the first predetermined timing.

4. The glow plug electrification control apparatus according to claim 1, wherein the temperature-raising-period electrification control means controls electrification in such manner that, even when a first glow plug and a second glow plug, which differ in resistance, are selectively connected to the electrification control apparatus and electrification control is performed therefor, at sampled timings during the temperature rise, electric power of the same magnitude as that supplied to the first glow plug is supplied to the second glow plug, if the temperature of the heat generation section of the second glow plug is raised under the same environmental temperature condition as the environmental temperature condition under which the temperature of the heat generation section of the first glow plug is raised.

5. The glow plug electrification control apparatus according to claim 4, wherein the first flow plug and the second glow plug are of the same industrial part number but differ in resistance due to a characteristic variation therebetween.

6. The glow plug electrification control apparatus according to claim 1, wherein the target resistance acquisition means acquires the target resistance using a predetermined primary expression having, as a variable, the temperature-raising-period resistance at the predetermined timing.

7. The glow plug electrification control apparatus according to claim 1, further comprising:

first environmental value acquisition means for acquiring a first environmental value for a predetermined environmental condition before or during the temperature-raising period; and second environmental value acquisition means for acquiring a second environmental value for the predetermined environmental condition during the maintaining period, wherein the maintaining-period electrification control means includes environment correction means for correcting the target resistance using the second environmental value and the first environmental value.

8. The glow plug electrification control apparatus according to claim 7, wherein the first environmental value acquisition means is a first water temperature acquisition means for acquiring, as the first environmental value, a first water temperature, which is a temperature of engine cooling water before or during the temperature-raising period;

the second environmental value acquisition means is a second water temperature acquisition means for acquiring, as the second environmental value, a second water temperature, which is a temperature of the engine cooling water during the maintaining period; and the environment correction means is a water temperature correction means for correcting the target resistance using the second water temperature and the first water temperature.

9. The glow plug electrification control apparatus according to claim 1, wherein the maintaining-period electrification control means comprises heat transfer correction means for correcting the target resistance in accordance with an increase in the maintaining-period resistance due to a temperature rise of resistor portions of the glow plug other than the heat generation section, which temperature rise occurs with a delay in relation to a temperature rise of the heat generation section.

10. The glow plug electrification control system comprising:

a glow plug electrification control apparatus according to claim 1;

a glow plug; and a lead wire for connecting the electrification control apparatus and the glow plug together.

* * * * *